US005443946A

United States Patent [19]

Asami

[11] Patent Number: 5,443,946

[45] Date of Patent: Aug. 22, 1995

[54] SILVER HALIDE COLOR PHOTOGRAPHIC MATERIAL AND METHOD FOR FORMING COLOR IMAGE

[75] Inventor: Masahiro Asami, Minami-ashigara, Japan

[73] Assignee: Fuji Photo Film Co., Ltd., Minami-ashigara, Japan

[21] Appl. No.: 151,763

[22] Filed: Nov. 15, 1993

Related U.S. Application Data

[63] Continuation of Ser. No. 894,553, Jun. 5, 1992, abandoned.

[51] Int. Cl.[6] ..... G03C 1/035; G03C 1/08

[52] U.S. Cl. ..... 430/567; 430/363; 430/505; 430/569; 430/607; 430/604; 430/944; 430/945

[58] Field of Search ..... 430/363, 505, 567, 569, 430/604, 607, 944, 945

[56] References Cited

U.S. PATENT DOCUMENTS

| | | | |
|---|---|---|---|
| Re. 28,668 | 10/1975 | Herz et al. | 430/611 |
| 3,703,584 | 11/1972 | Motter | 430/605 |
| 4,237,214 | 12/1980 | Mifune et al. | 430/567 |
| 4,269,927 | 5/1981 | Atwell | 430/567 |
| 4,374,196 | 2/1983 | Herz | 430/505 |
| 4,894,319 | 1/1990 | Ikeda et al. | 430/567 |
| 4,962,015 | 10/1990 | Aida et al. | 430/567 |
| 5,051,344 | 9/1991 | Kuno | 430/567 |
| 5,057,402 | 10/1991 | Shiba et al. | 430/604 |
| 5,079,138 | 1/1992 | Takada et al. | 430/567 |
| 5,126,275 | 6/1992 | Hioki | 430/944 |
| 5,149,619 | 9/1992 | Mihara et al. | 430/607 |
| 5,176,993 | 1/1993 | Ohshima | 430/567 |
| 5,206,133 | 4/1993 | Bando | 430/567 |
| 5,213,953 | 5/1993 | Yamamoto | 430/604 |

FOREIGN PATENT DOCUMENTS

| | | |
|---|---|---|
| 2036371 | 8/1991 | Canada . |
| 0423765 | 4/1991 | European Pat. Off. . |
| 2157749 | 6/1990 | Japan . |
| 3-84545 | 4/1991 | Japan . |
| 2109576 | 6/1983 | United Kingdom . |

*Primary Examiner*—Charles L. Bowers, Jr.
*Assistant Examiner*—Martin Angebranndt
*Attorney, Agent, or Firm*—Burns, Doane, Swecker & Mathis

[57] ABSTRACT

There is disclosed a silver halide photographic material and a method for forming a color image, which uses an emulsion that is suitable for scanning exposure by laser diodes, that is excellent in rapid processability, and that is high in sensitivity and contrast. And, there is provided a silver halide photographic material and a method for forming a color image, that uses an emulsion that is small in the fluctuation in gradation and sensitivity owing to a change in exposure illumination intensity and that is particularly small in the fluctuation in sensitivity owing to a change in temperature at the time of exposure in high-intensity exposure, such as laser scanning exposure. Disclosure described provides a silver halide color photographic material having photographic constitutional layers that comprise at least three photosensitive layers containing respectively different dye-forming couplers and at least one non-photosensitive hydrophilic layer, on a support, characterized in that said three photosensitive layers have spectral sensitivity maximums in respectively different wavelength regions that are over 650 nm; the silver halide emulsion contained in these three photosensitive layers contains 96 mol % or more of silver chloride; the silver halide grains contained in at least one of the photosensitive layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains; and a method for forming a color image.

9 Claims, No Drawings

SILVER HALIDE COLOR PHOTOGRAPHIC MATERIAL AND METHOD FOR FORMING COLOR IMAGE

This application is a continuation of application Ser. No. 07/894,553, filed Jun. 5, 1992, now abandoned.

FIELD OF THE INVENTION

The present invention relates to a photographic material in which an infrared-sensitive silver halide photographic emulsion is used, and more particularly to a photographic material in which a photographic emulsion is used that is excellent in rapid processability; that causes less fogging; that can give a high sensitivity and a high contrast; and that is small in the fluctuation in photographic performance due to a change in the temperature at the time of exposure and to a method for forming a color image.

BACKGROUND OF THE INVENTION

The system of recording an image by using silver halide grains as a photosensitive element and subjecting the image to so-called development processing to reproduce and preserve the image has developed remarkably in recent years and is applied in various fields. In particular, the market of color photographs, which many people use for the purpose of recording and appreciating images, is expanding year by year, and today everyone can readily obtain color prints.

On the other hand, new image-forming systems to which the technique of silver halide photographic materials is applied are suggested. As one such system, a system in which digitized image information is used to write an image directly into a photographic material can be mentioned. By using such a system, the gradation or the tone of the image data can be converted, or processing, for example for setting the layout arbitrarily, becomes possible. By using a laser beam as the output of digitized image information, an image output with high precision can be realized. By the recent development of laser diodes, production of simple and stable laser output apparatuses has become possible and the advent of such a system is expected. However, in laser diodes that now can be supplied stably, the emitting wavelength region is restricted to from the red region to the infrared region, and therefore in order to write image information using them it is necessary to use photographic materials that have spectral sensitivity in the infrared region. For example, U.S. Pat. Nos. 4,619,892 or 4,956,702 discloses a technique that uses a silver halide color photographic material provided with sensitivity in the infrared region as a photographic material for outputs from laser diodes.

In composing the above system, in the case wherein silver halide photographic materials are used, for example, the length of the processing time and the magnitude of the fluctuation of the processing are considered to constitute practical limitations. As a technique of overcoming these drawbacks, a method is known wherein color papers containing, instead of the silver chlorobromide emulsions conventionally widely used in photographic materials for color prints (hereinafter referred to as color papers), which are high in silver bromide content, so-called high-silver chloride emulsions, which are increased in silver chloride content, are processed. For example, International Application WO 87-04534 discloses a method of rapidly processing a color paper, wherein use is made of a high-silver chloride emulsion, with a color developer substantially free from sulfite ions and benzyl alcohol.

However, when spectral sensitivity was imparted to high-silver chloride emulsions to prepare photographic materials in which an image would be written by a laser diode and the photographic materials were subjected to various tests, it was found that the photographic materials had the following problems.

That is, even when high-silver chloride emulsions were sensitized to the infrared region, a high sensitivity was hardly available, and the fluctuation in sensitivity to such conditions as a change in temperature at the time of exposure was conspicuous. Further, it was made obvious that these drawbacks were inclined to be more aggravated in the case of high-intensity and short-period exposure, such as scanning exposure by a laser beam.

Many techniques for overcoming the above drawbacks involved in high-silver chloride emulsions have been reported to date.

For example, Japanese Patent Publication (OPI) Nos. Sho. 58-95736, 58-108533, 60-228844, and 60-222845 disclose high-silver chloride emulsions having different grain structures, with a layer having a high silver bromide content in silver halide grains, so as to impart a high sensitivity while suppressing fogging of the high-silver halide emulsions. However, the present inventors studied these techniques and as a result found that, according to these techniques, highly sensitive emulsions could indeed be obtained, but at the same time, when pressure was exerted on the emulsion grains, desensitization was liable to occur, constituting a major defect in practice.

On the other hand, Japanese Patent Application (OPI) No. Sho. 51-139323 or No. Sho. 59-171947 or British Patent Specification No. 2109576A, describes that when a compound of a metal of group VIII is incorporated, a high sensitivity is secured and reciprocity law failure is improved. Further, Japanese Patent Publication No. Sho. 49-33781, Japanese Patent Application (OPI) No. Sho. 50-23618, 52-18310, 58-15952, 59-214028, and 61-67845, German Patent Nos. 2,226,877 and 2,708,466, and U.S. Patent Specification No. 3,703,584 describe that when a rhodium compound or an iridium compound is incorporated, an improvement in high contrast and reciprocity law failure can be accomplished. However, when a rhodium compound is used, although a high-contrast emulsion can be obtained, conspicuous desensitization occurs, which is not preferable in practice. When an iridium compound is used, so-called latent-image sensitization, i.e., an increase in development density due to the lapse of time from the exposure of the photographic material to the processing, is observed strikingly, which is not preferable in practice.

Further, U.S. Pat. No. 4,269,927 describes that a high sensitivity can be obtained when cadmium, lead, copper, zinc, or a mixture of these is contained within surface-latent-image type high-silver chloride grains having a silver chloride content of 80 mol % or more. However, although these methods provide increase in sensitivity and a small effect of improving reciprocity law failure, the improvement in the fluctuation in sensitivity owing to a change in temperature at the time of exposure is not satisfactory.

Further, Japanese Patent Publication No. Sho. 48-35373 describes that a high-contrast black-and-white photographic print paper can be obtained inexpensively by mixing a water-soluble iron compound with a silver chloride emulsion obtained by the normal precipitation method. Although this method definitely increases the high intensity sensitivity of a silver chloride emulsion, the improvement in the fluctuation in sensitivity owing to a change in temperature at the time of exposure, particularly the improvement in temperature dependency of sensitivity of high-intensity exposure, is not satisfactory.

Further, Japanese Patent Application (OPI) No. Hei. 1-183647 describes that by placing a silver bromide localized layer in or on high-silver chloride grains containing iron ions, a high sensitivity can be obtained and the fluctuation in sensitivity owing to a change in temperature at the time of exposure can be alleviated. However, this method is not satisfactory enough to improve the temperature dependency of sensitivity of high-intensity exposure at the time of exposure.

Further, Japanese Patent Application (OPI) No. Hei. 3-84545 describes that a silver halide color photographic material, wherein each of three silver halide photosensitive layers that contain any one of a cyan coupler, a magenta coupler, and a yellow coupler, has spectral sensitivity peaks in three different wavelength regions of 650 nm or over; wherein the emulsions of these three photosensitive layers comprise silver chloride emulsions or silver chlorobromide emulsions containing 96 mol % or more of silver chloride; and wherein the emulsion of at least one of the three photosensitive layers comprises a silver iodochloride emulsion or a silver iodochlorobromide emulsion containing 0.01 to 3 mol % of silver iodide on the surface or subsurface of the grains, said photographic material gives a high sensitivity and an effect less dependent on exposure temperature. But though such a photographic material does provide a remarkable effect, a further improvement in temperature dependency of high-intensity exposure sensitivity at the time of exposure is desired.

SUMMARY OF THE INVENTION

As is apparent from the above description, the first object of the present invention is to provide a silver halide emulsion, a silver halide photographic material which uses the same, and a method for forming a color image, that is suitable for scanning exposure by laser diodes; that is excellent in rapid processability; and that is high in sensitivity and contrast.

The second object of the present invention is to provide a silver halide emulsion, a silver halide photographic material that uses the same, and a method for forming a color image, that is small in the fluctuation in gradation and sensitivity owing to a change in exposure illumination intensity that is particularly small in the fluctuation in sensitivity owing to a change in temperature at the time of exposure in high-intensity exposure, such as laser scanning exposure.

Other objects, features, and advantages of the present invention will become more apparent from the following description.

DETAILED DESCRIPTION OF THE INVENTION

The above objects of the present invention have been attained by providing (1) a silver halide color photographic material having photographic constitutional layers that comprise at least three photosensitive layers each containing respectively different dye-forming couplers and at least one non-photosensitive hydrophilic layer, on a support, wherein said three photosensitive layers have spectral sensitivity maximums in respectively different wavelength regions that are over 650 nm; the silver halide emulsion in these three photosensitive layers each contains 96 mol % or more of silver chloride; the silver halide grains in at least one of the photosensitive layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains;

(2) the silver halide color photographic material as stated in (1), wherein the spectral sensitivity maximums of said three photosensitive layers are in the ranges of 650 to 690 nm, 720 to 790 nm, and 770 to 850 nm respectively;

(3) the silver halide color photographic material as stated in (1), wherein the silver halide grains in the layer having a spectral sensitivity maximum at the longest wavelength out of said three photographic layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains;

(4) the silver halide color photographic material as stated in (1), wherein the silver halide grains in the layer having a spectral sensitivity maximum at the longest wavelength and the layer having a spectral sensitivity maximum at the next longest wavelength out of said three photographic layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains;

(5) the silver halide color photographic material as stated in (1), wherein as the dye-forming couplers at least one cyan dye-forming coupler, at least one magenta forming coupler, and at least one yellow dye-forming coupler are incorporated;

(6) the silver halide color photographic material as stated in (1), wherein any one of said photographic constitutional layers comprising three photosensitive layers and at least one non-photosensitive hydrophilic layer on the support further contains a compound represented by the following formula (Ia), (Ib), (Ic), or (Id);

(7) the silver halide color photographic material as stated in (6), wherein the compound represented by formula (Ia), (Ib), (Ic), or (Id) is incorporated in any one of said three photosensitive layers;

(8) the silver halide color photographic material as stated in (7), wherein the compound represented by formula (Ia), (Ib), (Ic), or (Id) is incorporated in the layer having a spectral sensitivity maximum at the longer wavelength out of said three photosensitive layers;

(9) the silver halide color photographic material as stated in (7), wherein a compound represented by formula (Ia) is incorporated in the layer having a spectral sensitivity maximum at the longer wavelength out of said three photosensitive layers;

(10) a method for forming a color image, wherein a silver halide photographic material having photographic constitutional layers that comprise at least three photosensitive layers each containing respectively different dye-forming couplers and at least one non-photosensitive hydrophilic layer, on a support; wherein said three photosensitive layers have spectral sensitivity maximums in respectively different wavelength regions that are over 650 nm; the silver halide emulsion in these three photosensitive layers contains 96 mol % or more of silver chloride; the silver halide grains in at least one of the photosensitive layers contain 0.01 to 3 mol % of silver iodide and an iron compound in an amount of $10^{-7}$ to $10^{-3}$ mol per mol of the silver halide, and 80% or over of the total content of each of the silver iodide and the iron compound is present in the surface layer corresponding to no greater than 50% of the volume of grains from the surface of said silver halide grains; is subjected to scanning exposure by multiple laser beams having emission wavelengths in the above wavelength regions, so that the average exposure time per picture element may be $10^{-3}$ sec or less, and to color developing processing;

(11) the method for forming a color image as stated in (10), wherein the spectral sensitivity maximums of said three photosensitive layers are in the ranges of 650 to 690 nm, 720 to 790 nm, and 770 to 850 nm, respectively;

(12) the method for forming a color image as stated in (10), wherein the silver halide grains in the layer having a spectral sensitivity maximum at the longest wavelength out of said three photographic layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains;

(13) the method for forming a color image as stated in (10), wherein the silver halide grains in the layer having a spectral sensitivity maximum at the longest wavelength and the layer having a spectral sensitivity at the next longest wavelength out of said three photographic layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains;

(14) the method for forming a color image as stated in (10), wherein as the dye-forming couplers at least one cyan dye-forming coupler, at least one magenta forming coupler, and at least one yellow dye-forming coupler are incorporated;

(15) the method for forming a color image as stated in (10), wherein, within 40 sec after the exposure, a processing step in which the color developing time is 60 sec or less, the total processing time excluding the drying time, is 180 sec or less, and the drying time is 60 sec or less, is carried out;

(16) the method for forming a color image as stated in (10), wherein any one of said photographic constitutional layers comprising three photosensitive layers and at least one non-photosensitive hydrophilic layer further contains a compound represented by the following formula (Ia), (Ib), (Ic), or (Id);

(17) the method for forming a color image as stated in (16), wherein the compound represented by formula (Ia), (Ib), (Ic), or (Id) is incorporated in any one of said three photosensitive layers;

(18) the method for forming a color image as stated in (17), wherein the compound represented by formula (Ia), (Ib), (Ic), or (Id) is incorporated in the layer having a spectral sensitivity maximum at the longer wavelength out of said three photosensitive layers;

(19) the method for forming a color image as stated in (17), wherein a compound represented by formula (Ia) is incorporated in the layer having a spectral sensitivity maximum at the longer wavelength out of said three photosensitive layers, Formula (Ia)

Formula (Ia)

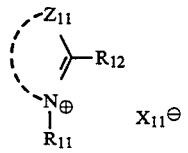

Formula (Ib)

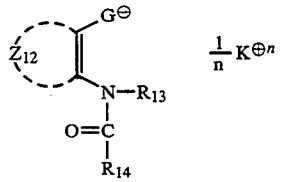

Formula (Ic)

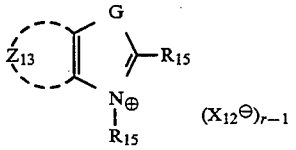

Formula (Id)

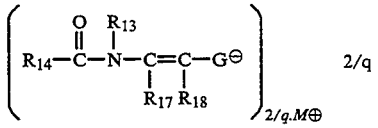

In formulae (Ia), (Ib), (Ic), and (Id), $Z_{11}$ represents a group of non-metallic atoms required to complete a 5- or 6-membered nitrogen-containing heterocyclic ring. $Z_{12}$ and $Z_{13}$ each represent atoms required to complete an aromatic ring. $R_{11}$ represents a hydrogen atom, an alkyl group, or an alkenyl group. $R_{12}$ represents a hydrogen atom or a lower alkyl group. $R_{13}$ represents an alkyl group or an alkenyl group. $R_{15}$ represents a substituted alkyl group or a substituted alkenyl group. $R_{14}$ and $R_{16}$ each represent a hydrogen atom, an alkyl group, or an aryl group. $R_{17}$ and $R_{18}$, which may be the same or different, each represent a hydrogen atom, an alkyl group, an aryl group, a cyano group, a halogen atom, an alkoxycarbonyl group, a carboxyl group, an aminocarbonyl group which may be substituted, a formyl group, an alkylcarbonyl group, an arylcarbonyl group, or an aryloxycarbonyl group. $X_{11}$ and $X_{12}$ each represent an acid anion (e.g., $Cl^-$, $Br^-$, $I^-$, and $ClO_4^-$). G represents an oxygen atom, a sulfur atom, a selenium atom, or a tellurium atom. $K^{+n}$ represents an n-valent cation selected from the group consisting of an onium ion, ions of elements of group IA or group IIA, and ions of metals of group IIB, group VIIB, group IVA, or group VA. r represents 1 or 2, and when the compound forms an inner salt, r is 1. q represents 1 or 2, and $M^{+2}/q$ represents a 2/q-valent cation.

The incorporating of silver iodide with a photographic silver halide emulsion is commonly used as a means of attaining a high sensitivity particularly in photographic materials for photography. However, it is known that silver iodide also has a strong development-inhibiting effect, and it is known that, particularly when mass production is intended by rapid processing, for example of print photographic materials, preferably silver iodide is not contained.

For example, as described in Japanese Patent Publication No. Sho. 49-46932, techniques that use a trace amount of silver iodide are known to be effective to intensify the adsorption of sensitizing dyes. However, in the method wherein silver iodide is to be introduced simply into a high-silver-chloride-emulsion suitable for rapid processing, even if the silver iodide is incorporated in a step of the formation of grains, or if a water-soluble iodide is added at the time of addition of a sensitizing dye after the completion of the formation of grains, excessive introduction of the silver iodide causes such a defect that fogging or softening of the gradation takes place, which constitutes an hindrance in practice in many cases.

By introducing an iodide together with an iron compound to high-silver chloride grains, as in like the mode of the present invention, effects that fogging occurs less, the spectral sensitization rate of an infrared sensitizing dye is increased, hard gradation is obtained even by high-intensity short-time exposure, and dependency on temperature at the time of exposure is small, can be obtained, which is a completely new finding not conventionally known.

The silver halide emulsion of the present invention contains grains made up of silver chloroiodide or silver chloroiodobromide containing 96 mol % or more of silver chloride and 0.01 to 3 mol % of silver iodide. The silver chloride content of the silver halide emulsion of the present invention is preferably 97 mol % or more, more preferably 98 mol % or more. The silver iodide content is preferably 0,015 to 2 mol %, more preferably 0.02 to 1 mol %, and most preferably 0.03 to 0.6 mol %.

When the silver halide emulsion of the present invention contains silver bromide, preferably the silver bromide is placed in the form of a silver bromide localized phase having a silver bromide content of less than 70 mol % in the interior of the grains or on the surface of the grains. At that time, the silver bromide localized phase may take the shape of a core in the grain, the shape of a shell in the form of a layer, or the shape of a nonlayered dispersion. An example of the last-mentioned shape is one wherein a silver bromide localized phase is epitaxially joined to the edges or corners of the surface of the grains.

In the present invention, to introduce an iodide into grains or to form a silver bromide localized phase as mentioned above, various methods can be used. For example, in a step of forming grains by a reaction between an aqueous soluble silver salt solution and an aqueous silver halide solution, by introducing a water-soluble salt, such as potassium iodide or potassium bromide, into the reaction system, a silver iodide or silver bromide containing phase can be formed. Alternatively, the introduction can be effected by converting an already formed silver halide to a silver halide smaller in solubility product. In addition already formed silver halides different in halogen composition can also be mixed and ripened, to cause recrystallization to take place, thereby forming a silver iodide or silver bromide containing phase.

The silver halide grains of the present invention as also required to contain an iron compound in an amount of $10^{-7}$ to $10^{-3}$ mol per mol of the silver halide.

In the present invention, to incorporate an iron compound into silver halide grains, it is easy to allow a water-soluble iron compound to be present in a step of forming said grains.

The iron compound is a compound containing a bivalent or trivalent iron ion and is preferably soluble in water in the range used in the present invention. A particularly preferable compound is an iron complex salt that can be easily taken into silver halide grains. Specific examples of these compounds are given below:

Ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric alubminate, ferric ammonium acetate, ferric bromide, ferric chloride, ferric chromate, ferric citrate, ferric bromide, ferric formate, ferric glycerophosphate, ferric hydroxide, acid ferric phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate, potassium hexacyanoferrate(II), potassium pentacyanoammineferrate(II), sodium ethylenedinitrilotetraacetic acid ferrate(III), potassium hexacyanoferrate(III), and potassium pentacyanonitrosylferrate.

Among these iron compounds, bivalent or trivalent iron complex compounds coordinated with 5 or 6 cyan ligands are particularly preferable.

The above iron compound can be contained in silver halide grains by allowing the iron compound to be present in a solution of a dispersing medium (gelatin or a polymer having protective colloidal properties), an aqueous halide solution, an aqueous silver salt solution, or some other aqueous solution, when the silver halide grains are formed.

In the present invention, the amount of the iron compound is in the range of $10^{-7}$ to $10^{-3}$ mol per mol of the silver halide. More preferably the range is from $10^{-6}$ to $5\times10^{-4}$ mol.

In the present invention, 80% or more of the iron compound used is locally present in the surface layer corresponding to no greater than 50% of the volume of grains from the surface of the silver halide grains. The volume of the surface layer is preferably 40% or less, more preferably 20% or less. There is no particular lower limit on the volume of the surface layer, but the volume of the surface layer is generally 2% or more, preferably 4% or more. If the surface layer is as small in volume (thin) as possible, the internal sensitivity can be inhibited from increasing, which is favorable to obtain high sensitivity. In order to concentrate the iron compound into the surface layer of silver halide grains, after silver halide grain cores, excluding the surface layer, are formed, the iron compound is supplied at the time of the addition of the aqueous silver salt solution and the aqueous halide solution for the formation of the surface layer.

In the present invention, the amount of the iron compound to be contained in the silver halide grains is preferably in the range already mentioned. If the amount is much smaller than the defined amount of the present invention, its effect is hardly obtained, whereas if the amount is excessive, such a defect arises that desensitization due to pressure is apt to occur.

In the silver halide grains of the present invention, preferably the site containing silver iodide and the site containing the iron compound overlap, and more preferably they coincide.

The silver halide photographic emulsion of the present invention is preferably one wherein the average grain size of the silver halide grains contained therein (the average grain size is obtained in such a way that the diameters of circles equivalent to the projected areas of the grains are assumed to be grain sizes and expressed by number average) is 0.1 μm to 2.0 μm.

Their grain size distribution is such that the deviation coefficient (obtained by dividing the standard deviation of the grain size distribution by the average grain size) is 20% or less, preferably 15%; that is, a so-called monodisperse emulsion is preferable. For the purpose of obtaining a wide latitude, it is also preferable to use such monodisperse emulsions to be blended to form a layer or to be coated to form layers one over the other.

By incorporating the compounds represented by formulas (Ia), (Ib), (Ic), and (Id) into the photographic material of the present invention, the effect of the present invention, i.e., the effect of making small the temperature dependency of high-intensity exposure sensitivity at the time of exposure, can be further enhanced.

Although the compounds represented by formulas (Ia), (Ib), (Ic), and (Id) can be incorporated in any layer constituting the photographic material, the compounds are preferably added to a photosensitive layer that contains a silver halide emulsion. The effect of the compounds is greater when they are added to a layer that has its spectral sensitivity maximum at a longer wavelength among the photosensitive layers.

Although the amount of the compounds represented by formulas (Ia), (Ib), (Ic), and (Id) to be added ranges widely depending on the properties of the used silver halide emulsion, preferably the amount is in the range of $10^{-6}$ to $10^{-2}$ mol per mol of the silver halide.

The compounds represented by formulas (Ia), (Ib), (Ic), and (Id) can be dispersed directly into the emulsion; or they can be dissolved in a suitable solvent (e.g., water, methyl alcohol, ethyl alcohol, propanol, methyl cellosolve, or acetone) or a solvent mixture made up of these solvents and the solution may be added to the emulsion. Alternatively, the compounds can be dispersed in a colloid and the dispersion may be added to the emulsion.

Formulas [Ia], [Ib], [Ic], and [Id] will now be described in detail.

In the formulas, $Z_{11}$ represents a group of non-metallic atoms required to complete a 5-membered or 6-membered nitrogen-containing heterocyclic ring. $Z_{12}$ and $Z_{13}$ each represent atoms required to complete an aromatic ring. $R_{11}$ represents a hydrogen atom, an alkyl group, or an alkenyl group. $R_{12}$ represents a hydrogen atom or a lower alkyl group. $R_{13}$ represents an alkyl group or an alkenyl group. $R_{15}$ represents a substituted alkyl group or a substituted alkenyl group. $R_{14}$ and $R_{16}$ each represent a hydrogen atom, an alkyl group, or an aryl group. $R_{17}$ and $R_{18}$, which may be the same or different, each represent a hydrogen atom, an alkyl group, an aryl group, a cyano group, a halogen atom, an alkoxycarbonyl group, a carboxyl group, an aminocarbonyl group which may be substituted, a formyl group, an alkylcarbonyl group, an arylcarbonyl group, or an aryloxycarbonyl group. $X_{11}$ and $X_{12}$ each represent an acid anion. G represents an oxygen atom, a sulfur atom, a selenium atom, or a tellurium atom. $K^{+n}$ represents an n-valent cation selected from the group consisting of an onium ion, ions of elements of group IA or group IIA, and ions of metals of group IIB, group VIIB, group IVA, or group VA. r represents 1 or 2, and when the compound forms an inner salt, r is 1. q represents 1 or 2, and $M^{+2}/q$ represents a 2/q-valent cation.

In more further detail, $Z_{11}$ represents a group of non-metallic atoms required to complete a 5- or 6-membered nitrogen-containing heterocyclic group. This ring may be condensed with a benzene ring or a naphthalene ring. Examples are thiazoliums (e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, and naphtho[2,1-d]thiazolium), oxazoliums (e.g., oxazolium, 4-methyloxazolium, benzooxazolium, 5-chlorobenzooxazolium, 5-phenylbenzooxazolium, 5-methylbenzooxazolium, and naphtho[1,2-d]oxazolium), imidazoliums (e.g., 1-methylbenzimidazolium, 1-propyl-5-chlorobenzimidazolium, 1-ethyl-5,6-dichlorobenzimidazolium, and 1-allyl-5-trifluoromethyl-5-chloro-benzimidazlium), and selenazoliums (e.g., benzoselenazolium, 5-chlorobenzoselenazolium, 5-methylbenzoselenazolium, 5-methoxybenzoselenazolium, and naphtho[1,2-d]selanazolium). $R_{11}$ represents a hydrogen atom, an alkyl group (preferably having 8 or less carbon atoms such as methyl, ethyl, propyl, butyl, and pentyl, or an alkenyl group (e.g., allyl). $R_{12}$ represents a hydrogen atom or a lower alkyl group (e.g., methyl and ethyl). $X_{11}$ represents an acid anion (e.g., $Cl^-$, $Br^-$, $I^-$, $ClO_4^-$) and $Z_{11}$ preferably represents thiazoliums with more preference given to a substituted or unsubstituted benzothiazolium or naphthothiazolium.

$R_{13}$ represents an alkyl group or an alkenyl group.

$R_{15}$ represents a substituted alkyl group or a substituted alkenyl group.

$R_{14}$ and $R_{16}$ each represent a hydrogen atom, an alkyl group, or an aryl group.

G represents an oxygen atom, a sulfur atom, a selenium atom, or a tellurium atom.

$Z_{12}$ and $Z_{13}$ each represent atoms required to form an aromatic ring.

$K^{+n}$ represents an n-valent cation selected from the group consisting of an onium ion, metal ions of elements of group IA or group IIA, and ions of metals of group IIB, group VIIB, group IVA, or group VA.

$X_{12}$ have the same meaning as that of $X_{11}$ of formula (Ia).

r represents 1 or 2 and when the compound forms an inner salt, r is 1.

The alkyl group represented by $R_{13}$ includes substituted alkyls. As the unsubstituted alkyl group, an unsubstituted alkyl group having 1 to 8 carbon atoms can be mentioned such as methyl, ethyl, propyl, butyl, pentyl, heptyl, or octyl.

As the substituted alkyl group, alkyl groups (having preferably 6 or less carbon atoms in alkyl portion) substituted, for example, by a carboxyl group, a sulfo group, a cyano group, a halogen atom (e.g., a fluorine atom, a chlorine atom, and a bromine atom), a hydroxyl group, an alkoxycarbonyl group (preferably having 8 or less carbon atoms, such as methoxycarbonyl, ethoxycarbonyl, and benzyloxycarbonyl), an alkoxy group (preferably having 7 or less carbon atoms, such as methoxy, ethoxy, propoxy, butoxy, and benzyloxy), an aryloxy group (e.g., phenoxy and p-tolyloxy), an acyloxy group (preferably having 3 or less carbon atoms, such as acetyloxy and propionyloxy), an acyl group (preferably having 8 or less carbon atoms, such as acetyl, propionyl, benzoyl, and mesy), a carbamoyl group (e.g., carbamoyl, N,N-dimethylcarbamoyl, morpholinocarbamoyl, and piperidinocarbamoyl), a sulfamoyl group (e.g., sulfamoyl, N,N-dimethylsulfamoyl, and morpholinosulfonyl), or an aryl group (e.g., phenyl, p-hydroxyphenyl, p-carboxyphenyl, p-sulfophenyl, and α-naphthyl) can be mentioned. Two or more of these substituents may be on the alkyl group.

The alkenyl group represented by $R_{13}$ includes substituted alkenyl groups. As the unsubstituted alkenyl group, preferably an unsubstituted alkenyl group having 3 to 8 carbon atoms such as allyl, 3-butenyl, 2-butenyl, 4-pentenyl, 3-pentenyl, and 5-hexenyl can be mentioned. As substituents on the substituted alkenyl group, those mentioned as substituents on the alkyl group represented by $R_{13}$ can be mentioned.

As substituents on the substituted alkyl groups represented by $R_{15}$ and the substituted alkenyl groups represented by $R_{15}$, the substituents described above for $R_{13}$ can be mentioned. The number of carbon atoms in the alkyl base of the substituted alkyl group is preferably 1 to 8 and the number of carbon atoms in the alkenyl base of the substituted alkenyl group is preferably 3 to 8. Examples are methoxyethyl, phenylethyl, ethoxypropyl, carboxypropyl, chloropropyl, benzylally, chloroethyl, phenylpropyl, fluoroethyl, and methylsulfonamidoethyl.

$R_{14}$ and $R_{16}$ each represent a hydrogen atom, an alkyl group (the alkyl group includes substituted alkyl groups, and preferably unsubstituted alkyl has 1 to 8 carbon atoms. Examples of the alkyls are methyl, ethyl, propyl, butyl, pentyl, heptyl, and octyl, examples of the substituents are those substituents possessed by $R_{13}$ mentioned above, and the number of carbon atoms of the alkyl base of these substituents is preferably 1 to 8), or an aryl group (including substituted aryl groups, such as phenyl and naphthyl, the substituent includes those substituents described for $R_{13}$ and the number of carbon atoms of the aryl moiety of the substituted aryl group having the substituent is preferably 6 to 12).

The aromatic ring completed by $Z_{12}$ and $Z_{13}$ is one having 6 to 10 ring carbon atoms (e.g., phenyl and naphthyl).

Useful substituents possessed by $Z_{12}$ and $Z_{13}$ include those substituents described for $R_{13}$.

The cation K represents an inorganic or organic cation such as an onium ion (e.g., ammonium, sulfonium, alkylammonium, arylammonium, alkylsulfonium, or arylsulfonium), an ion of an element of group IA of the periodic system (e.g., an ion of an alkali metal such as lithium, sodium, or potassium), an ion of an alkali earth metal of group IIA of the periodic system (e.g., magnesium, calcium, or strontium), or an ion of a metal of group IIB, VIIB, IVA, or VA of the periodic system (e.g., an ion of manganese, cadmium, lead, or bismuth). (The periodic system mentioned herein refers to the periodic system shown in Webater's Seventh New Collegiate Dictionary, page 628, 1969, G & G Morrlam Company, Spring Field, Mass., U.S.A.)

As the acid anion represented by $X_{11}$ and $X_{12}$, for example, $Cl^-$, $Br^-$, $I^-$, and $ClO_4^-$ can be mentioned.

The number of carbon atoms of the alkyl moiety of each of the alkyl group, the alkoxycarbonyl group, and the alkylcarbonyl group represented by $R_{17}$ and $R_{18}$ is preferably 10 or less, examples of the alkyl group are a methyl group, an ethyl group, a propyl group, a butyl group, a heptyl group, a hexyl group, an octyl group, a 2-ethylhexyl group, and a decyl group, and they include substituted and unsubstituted groups. Useful substituents are halogen atoms, a cyano group, an aryl group, a carboxyl group, an alkylcarbonyl group, an arylcarbonyl group, and an alkylamino group having 6 or less carbon atoms.

The number of carbon atoms of the aryl moiety of each of the aryl group, the arylcarbonyl group, and the aryloxycarbonyl group is preferably 16 or less and they include unsubstituted and substituted groups. Preferable substituents include, for example, a halogen atom, a cyano group, a sulfo group, an carboxyl group, and an alkyl group, an alkoxy group, an alkylcarbonyl group, an alkoxycarbonyl group, a perfluoroalkyl group, an alkylaminocarbonyl group, and an alkylcarbonylamino group that have 6 or less carbon atoms, and an aryl group, an arylcarbonyl group, and an aryloxy carbonyl group that have 10 or less carbon atoms.

The cation represented by $M^{+2}/q$ includes organic and inorganic ions and preferable examples include, for example, a proton, ammoniums (e.g., ammonium, benzylammonium, triethylammonium, and benzylmethylammonium), pyridinium, an alkali metal ion (e.g., $Na^+$ and $K^+$), an alkali earth metal ion (e g , $Ca^{2+}$), $Zn^{2+}$, and $Ag^+$.

Specific examples of the compounds represented by formula (Ia), (Ib), (Ic), and (Id) are shown below, but the present invention is not limited to them.

(Ia-1)

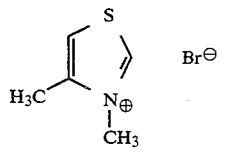

(Ia-2)

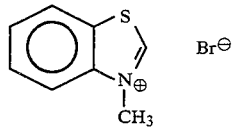

(Ia-3)

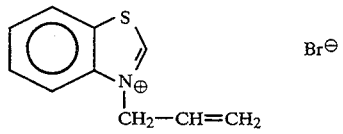

(Ia-4)

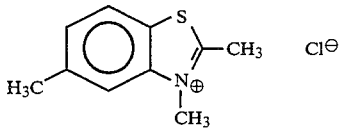

(Ia-5)

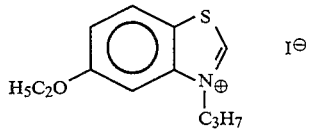

-continued
(Ia-6)
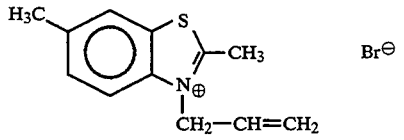
(Ia-7)
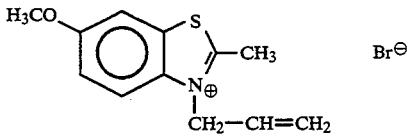
(Ia-8)
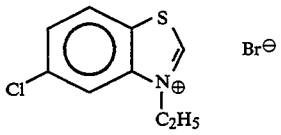
(Ia-9)
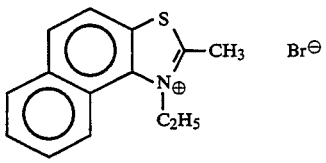
(Ia-10)
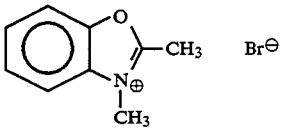
(Ia-11)
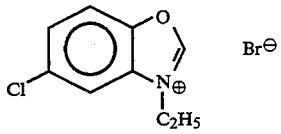
(Ia-12)
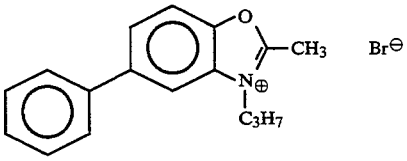
(Ia-13)
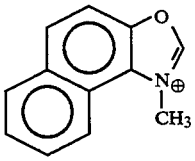
(Ia-14)
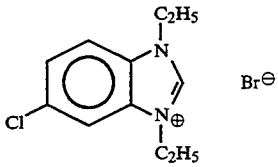
(Ia-15)
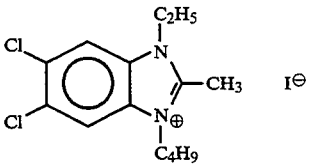
-continued
(Ia-16)
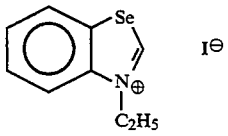
(Ia-17)
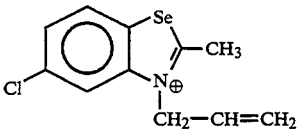
(Ia-18)
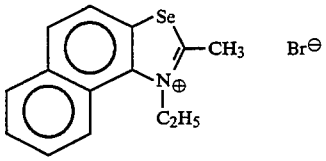
(Ib-1)
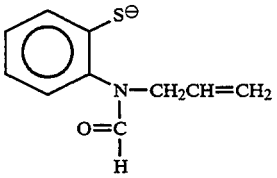
(Ib-2)
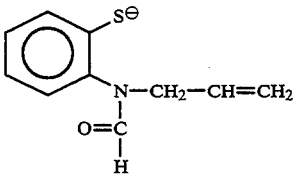
(Ib-3)
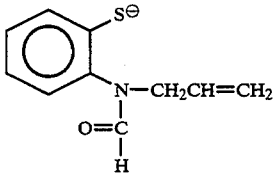
(Ib-4)
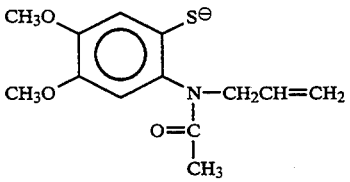
(Ib-5)
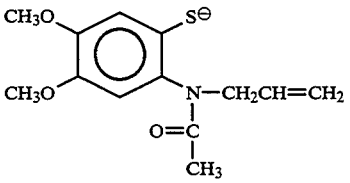
(Ib-6)
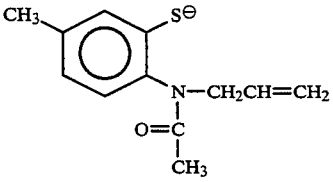

-continued
(Ib-7)
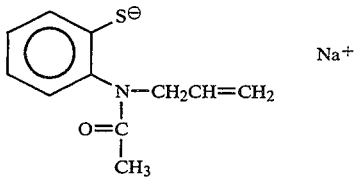
(Ib-8)
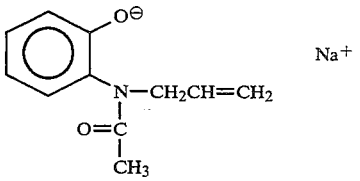
(Ib-9)
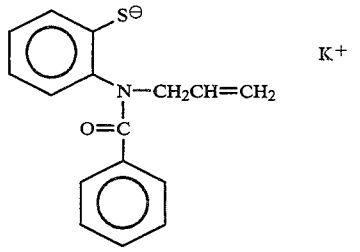
(Ib-10)
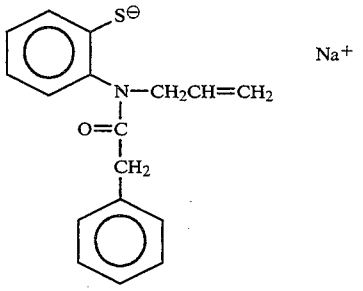
(Ib-11)
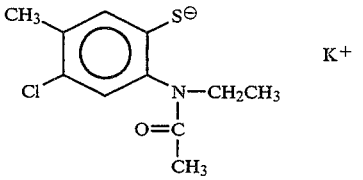
(Ib-12)
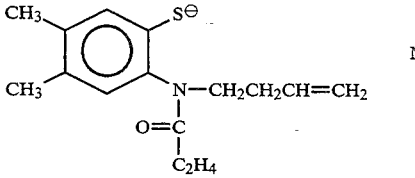
(Ib-13)
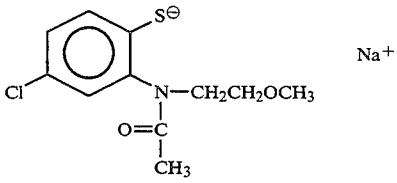
-continued
(Ib-14)
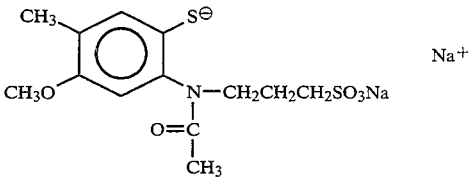
(Ib-15)
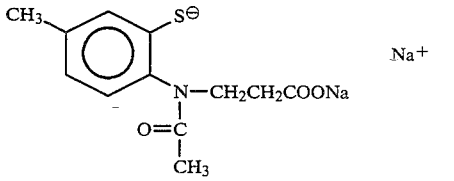
(Ic-1)
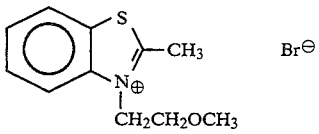
(Ic-2)
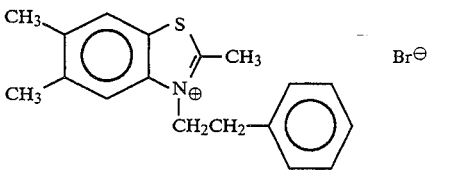
(Ic-3)
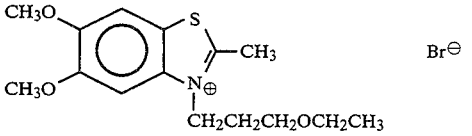
(Ic-4)
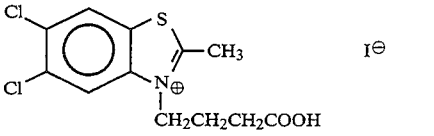
(Ic-5)
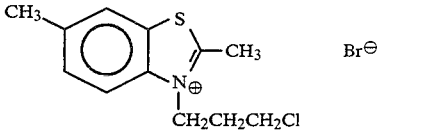
(Ic-6)
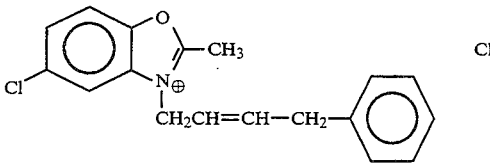
(Ic-7)
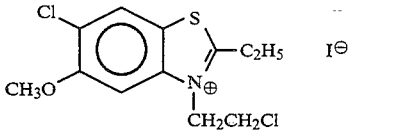

-continued (Ic-8)

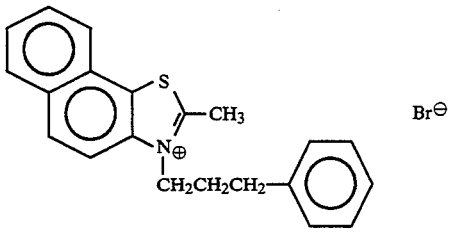

(Ic-9)

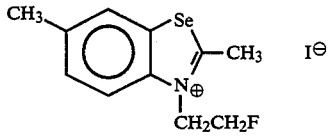

(Ic-10)

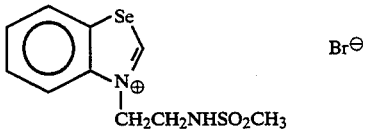

(Id-1)

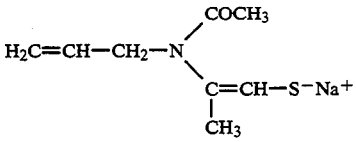

(Id-2)

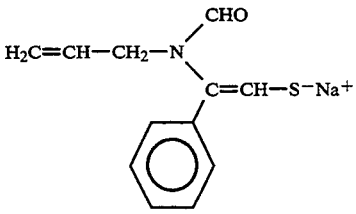

As to the shape of the silver halide grains contained in the photographic emulsion of the present invention, preferably use can be made of grains in a regular crystal form, such as cubic, tetradecahedral, or octahedral, but grains in an irregular crystal form, such as spherical or tabular, may be present in a mixture thereof. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be used.

The silver chloromide emulsion used in the present invention can be prepared by methods described, for example, in Chimie et Phisique Photographique by P. Glafkides (published by Paul Montel, 1967), in Photographic Emulsion Chemistry by G. F. Duffin (published by Focal Press, 1966), and in Making and Coating Photographic Emulsion by V. L. Zelikman et al. (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, in addition to the iron compound various polyvalent metal ion impurities can be introduced during the formation or physical ripening of the emulsion grains. Examples of such compounds to be used include salts of cadmium, zinc, lead, copper, and thallium, salts or complex salts of an element of Group VII, such as rhenium, and salts or complex salts of an element of Group VIII, such as ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

Generally, the silver halide photographic emulsion of the present invention is chemically and spectrally sensitized.

As the chemical sensitization, for example, sulfur sensitization, in which typically an unstable sulfur family compound is added; selenium sensitization; tellurium sensitization; noble metal sensitization, represented by gold sensitization; and reduction sensitization can be used alone or in combination. As compounds used in the chemical sensitization, unstable sulfur family compounds, such as sodium thiosulfate, sodium sulfide, trisubstituted thioureas, thiocarbamides, allyisocyanates, and thioformamides, as well as those described in Japanese Patent Application (OPI) No. Sho. 62-215272, page 18 (right lower column) to page 22 (right upper column), can be preferably used.

The spectral sensitization is effected for the purpose of imparting spectral sensitization in a desired light wavelength region to the silver halide photographic emulsion of the present invention. In the present invention, the spectral sensitization is preferably effected by adding a dye having absorption in the wavelength region corresponding to the intended spectral sensitivity (a spectral sensitizing dye). As the spectral sensitizer used at that time, for example, those described in Heterocyclic compounds-Cyanine dyes and related compounds by F. M. Harmer published by John Wiley & Sons [New York, London], 1964), can be mentioned. As specific examples of the compounds and spectral sensitization, those described in the above-mentioned Japanese Patent Application (OPI) No. Sho. 62-215272, page 22 (right upper column) to page 38, are preferably used.

In the present invention, silver chloroiodide or silver bromochloroiodide containing silver iodide and an iron compound contained in grains is required to be contained in at least one photosensitive layer on a base, and preferably, out of at least three photosensitive layers having different spectral sensitivity regions of wavelengths of 650 nm or above, the photosensitive layer having its spectral sensitivity maximum in the longest-wavelength region, contains the above emulsion. Moreover, preferably the above emulsion is contained in the photosensitive layer having its spectral sensitivity maximum in the longest-wavelength region and in the photosensitive layer having its spectral sensitivity maximum at the next longest wavelength. In the present invention it is preferred to have a constitution that both the spectral sensitivity maximum of the photosensitive layer that have its spectral sensitivity maximum in the longest-wavelength region and the spectral sensitivity maximum of the photosensitive layer that have its spectral sensitivity maximum at the next longest-wavelength are 720 nm or more and that the above emulsion is incorporated in these layers, so that the effect of the present invention can be remarkably exhibited.

In some cases, preferably the silver bromochloroiodide emulsion or silver chloroiodide emulsion containing silver iodide and an iron compound contained in the grains is incorporated in each of the three photosensitive layers.

Preferably the three photosensitive layers of the silver halide color photographic material in the present invention are respectively a photosensitive layer having its spectral sensitivity maximum at 650 nm to 690 nm, a photosensitive layer having its spectral sensitivity maximum at 720 to 790 nm, and a photosensitive layer having its spectral sensitivity maximum at 770 to 850 nm, but the present invention is not restricted to them.

When the silver halide color photographic material of the present invention is subjected to scanning exposure by light having the above wavelengths, a high and stable sensitivity can be obtained. Preferably the scanning exposure is given in such a way that the average exposure time of one picture element is $10^{-3}$ sec or less, more preferably $10^{-5}$ sec or less. It is most preferable if exposure of $10^{-7}$ sec or less can be given, it is preferable because an image can be obtained rapidly. Intermittent exposure or multiple exposure, caused by allowing such short-time high-intensity scanning exposures to adjoin and overlap, is possible, and this is preferable in some cases in view of the exposure properties of the photographic material or in view of the formation of an image by a scanning line.

Preferably the subsequent development processing, wherein the color development time is 60 sec or less, the total processing time, excluding the drying time, is 180 sec or less, and the drying time is 60 sec or less, is started within 40 sec after the scanning exposure, in order to carry out stable and rapid processing. Further, after the scanning exposure, it is preferable to start processing, wherein the color development time is 20 sec or less, the total processing time, excluding the drying time, is 90 sec or less, and the drying time is 30 sec or less, within 20 sec; and most preferably, after the scanning exposure, processing, wherein the color development time is 10 sec or less, the total processing time, excluding the drying time, is 45 sec or less, and the drying time is 15 sec or less, is started within 5 sec.

The processing step is preferably made up of a color-developing step, a bleach-fix step, a washing or stabilizing step, and a drying step; but the bleach-fix step may be divided into a bleach step and a fixing step, which may be used in combination. Although the color-developing step and the bleach/fix step may be steps comprising a so-called running replenishment system, in the present invention, the color developing step and the bleach/fix step are steps comprising preferably a disposing system or a batch-wise disposing system; and particularly when the content of the silver iodide contained in the silver halide in the photographic material is relatively high, that system is preferable, because the processing performance can be kept stable.

In the section from the exposure to the development processing, preferably the photographic material is transported approximately orthogonally to the scanning direction of the exposure, and the relationship of its traveling speed with the traveling speed in the development processing step is set such that the first-mentioned traveling speed is from 0.8 to 1.2 times the traveling speed in the development processing step, because the dwell time and the waiting time of the photographic material to be transported are reduced and the total rapid processability is improved. More preferably the traveling speed ratio is set to be from 0.8 to 1.1, most preferably about 1. In this case, not only the dwell time and the waiting time of the photographic material to be transported become null, thereby improving the rapid processability, but also the period from the exposure of the photographic material to the time when the photographic material has been developed becomes uniform throughout the photographic material, which, in combination with the property of the present photographic material, wherein the behavior of the change in the latent image after the exposure is stable, makes it possible to form an image that is stable and is further hardly influenced.

A specific example of a semiconductor laser that can be used in the present invention is one in which use is made of Ini-xGaxP (~700 nm), GaAsi-xPx (610 nm to 900 nm), Gai-xAlAs (690 to 900 nm), or the like as a light emission element. Besides the above semiconductor laser, a YAG laser wherein an Nb: YAG crystal is excited with a GaAsxPi-x light-emitting diode can be used for exposing the present photographic material to light. Preferably a selection is made among semiconductor laser luminous fluxes of 670, 680, 750, 780, 810, and 830 nm.

Preferably, the yellow-coupler-containing photosensitive layer, the magenta-coupler-containing photosensitive layer, and the cyan-coupler-containing photosensitive layer in the color photosensitive material of the present invention have spectral sensitivities suitable to a combination of three wavelength laser luminous fluxes respectively as follows:

| | |
|---|---|
| (Example-1) emitting wavelength: | 660 to 680 nm (AlGaInP) |
| | 730 to 770 nm (GaAlAs) |
| | 790 to 830 nm (GaAlAS) |
| (Example-2) emitting wavelength: | 660 to 680 nm (AlGaInP) |
| | 760 to 790 nm (GaAlAS) |
| | 810 to 850 nm (GaAlAS) |
| (Example-3) emitting wavelength: | 660 to 680 nm (AlGaInP) |
| | 730 to 770 nm (GaAlAs) |
| | 810 to 850 nm (GaAlAs) |

For the present invention, the output apparatus described in Japanese Patent Application (OPI) No. Hei. 2-74942 can be used.

Preferably, the silver halide photographic layer of the present invention is spectrally sensitized selectively in conformity to the wavelength of semiconductor laser luminous fluxes in one of the wavelength regions of 650 nm to 690 nm, 720 to 790 nm, and 770 to 850 nm.

In the present invention, the expression "is spectrally sensitized selectively in conformity to the wavelength of semiconductor laser luminous fluxes in one of the wavelength regions of 660 nm to 690 nm, 720 to 790 nm, and 770 to 850 nm" means that spectral sensitization is carried out practically such that the major wavelength of one laser luminous flux is positioned in one of the above wavelength regions, and the sensitivity of the other photosensitive layer at the major wavelength is lower by at least 0.5 (in terms of logarithm) than the sensitivity at the major wavelength of the particular laser luminous flux of a major photosensitive layer spectrally sensitized suitably to the major wavelength of the laser luminous flux. In other words, the sensitivity difference between the sensitivity of the particular photosensitive layer and the sensitivity of the other photosensitive layer, at the major wavelength, is 0.5 or more (in terms of logarithm). Therefore, preferably the major sensitivity wavelengths of photosensitive layers are set to be at least 30 nm apart for the major wavelength of the used semiconductor laser luminous flux. The sensitizing dye to be used is one that gives both high sensitivity at the major wavelength and a sharp spectral sensitivity distribution. The reason the expression "major wavelength" is used is that although a laser beam is fundamentally coherent light, actually there is incoherency, and therefore a width to some extent must be taken into consideration.

As the spectrally sensitizing dye used for the above purpose, for example, cyanine dyes, merocyanine dyes, and complex merocyanine dyes can be mentioned.

Specifically, spectrally sensitizing dyes described in Japanese Patent Application (OPI) No. Hei. 3-15049, page 6 (left upper column) to page 8 (right lower column), and page 10 to page 21 (left lower column), are preferably used.

Further, the following types of infrared spectrally sensitizing dyes that contain a heterocyclic group as an N-substituted group of a basic nucleus are also preferably used.

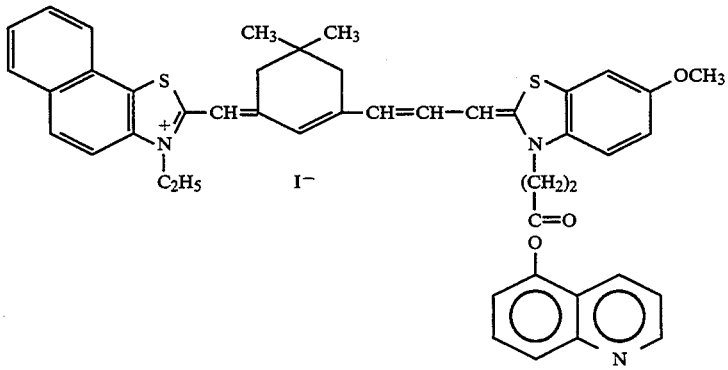

(Q-120)

The sensitizing dye to be used in the present invention is contained generally $5\times10^{-7}$ mol to $5\times10^{-3}$ mol, preferably $1\times10^{-6}$ mol to $1\times10^{-3}$ mol, particularly preferably $2\times10^{-6}$ mol to $5\times10^{-4}$ mol, per mol of silver halide, in the silver halide emulsion layer.

The sensitizing dye to be used in the present invention can be dispersed directly in an emulsion. Further, it may be firstly dissolved in a suitable solvent, such as methyl alcohol, ethyl alcohol, methyl cellosolve, aceton, water, pyridine, and a mixed solvent thereof, and then added into an emulsion in a form of solution. Further, supersonic wave can be used for dissolving the dye. Besides the above, a known method for adding the sensitizing dye may be adapted.

The sensitizing dye may be uniformly dispersed in a silver halide emulsion before when it is coated on a suitable support. Further, it may be added before a chemical sensitization or at the later half of grain formation of silver halide.

Further, at the spectral sensitization, the effect of spectral sensitization can be increased by a combination use with a known supersensitizer.

As such a supersensitizer the compound described in the above mentioned Japanese Patent Application (OPI) No. Hei. 3-15049, from right upper column on page 22 to right lower column on page 28.

In the photographic material according to the present invention, in order to improve, for example, sharpness of the image, preferably a dye that can be decolored by processing (in particular an oxonol dye), as described in European Patent EP 0,337,490A2, pages 27 to76, is added to a hydrophilic layer, so that the optical reflection density of the photographic material at 680 nm may be 0.70 or over, or 12 wt % or more (preferably 14 wt % or more) of titanium oxide the surface of which has been treated with secondary to quaternary alcohol (e.g., trimethylolethane) or the like is contained in a water-resistant resin layer of the support.

As a high-boiling organic solvent for photographic additives, such as cyan, magenta, and yellow couplers that can be used in the present invention, any compound can be used if the compound has a melting point of 100° C. or below and a boiling point of 140° C. or over; if it is immiscible with water; and if it is a good solvent for the coupler. The melting point of the high-boiling organic solvent is preferably 80° C. or below and the boiling point of the high-boiling organic solvent is preferably 160° C. or over, more preferably 170° C. or over.

Details of these high-boiling organic solvents are described in Japanese Patent Application (OPI) No. Sho. 62-215272, from page 137 (right lower column) to page 144 (right upper column).

The cyan, magenta, or yellow coupler can be emulsified and dispersed into a hydrophilic colloid, by impregnating into a loadable latex polymer (e.g., see U.S. Pat. No. 4,203,716) in the presence or absence of the above high-boiling organic solvent, or by dissolving together with a polymer insoluble in water but soluble in organic solvents.

Preferably, homopolymers and copolymers described in U.S. Pat. No. 4,857,449 and International Publication WO 88/00723, pages 12 to 30, are used, and more preferably methacrylate polymers or acrylamide polymers, particularly preferably acrylamide polymers, are used in view of dye image stabilizing.

In the photographic material according to the present invention, preferably together with the coupler a dye image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in Japanese Patent Application (OPI) No. Sho. 63-271247, is preferably added in order to prevent the growth of a variety of mildews and fungi that will propagate in the hydrophilic layer and deteriorate the image thereon.

As a support to be used for the photographic material of this invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the support is set in the range of 0.35 to 0.8, so that the display can be appreciated through either reflected light or transmitted light.

The exposed photographic material may be subjected to conventional color processing, and preferably it is subjected to bleach-fixing processing after color development processing. The pH of the bleach-fix solution is preferably about 6.5 or below, more preferably about 6 or below, for the purpose of the acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publication, particularly in European Patent EP 0,355,660A2 (Japanese Patent Application (OPI) No. Hei. 2-139544), are preferably used.

| Element constituting photographic material | Japanese Patent Application (OPI) No. Sho. 62-215272 | Japanese Patent Application (OPI) Hei. 2-33144 | EP 0,355,660A2 |
|---|---|---|---|
| Silver halide emulsion | p.10 upper right column line 6 to p.12 lower left column line 5, and p.12 lower right column line 4 from the bottom to p.13 upper left column line 17 | p.28 upper right column line 16 to p.29 lower right column line 11 and p.30 lines 2 to 5 | p. 45 line 53 to p. 47 line 3 and p. 47 lines 20 to 22 |
| Solvent for silver halide | p.12 lower left column line 6 to 14 and p.13 upper left column line 3 from the bottom to p.18 lower left column last line | — | — |
| Chemical sensitizing agent | p.12 lower left column line 3 from the bottom to lower right column line 5 from the bottom and p.18 lower right column line 1 to p.22 upper right column line 9 from the bottom | p.29 lower right column line 12 to last line | p.47 lines 4 to 9 |
| Spectral sensitizing agent (method) | p.22 upper right column line 8 from the bottom to p.38 last line | p.30 upper left column lines 1 to 13 | p.47 lines 10 to 15 |
| Emulsion stabilizer | p.39 upper left column line 1 to p.72 upper right column last line | p.30 upper left column line 14 to upper right column line 1 | p.47 lines 16 to 19 |
| Developing accelerator | p.72 lower left column line 1 to p.91 upper right column line 3 | — | — |
| Color coupler (Cyan, Magent, and Yellow coupler) | p.91 upper right column line 4 to p.121 upper left column line 6 | p.3 upper right column line 14 to p.18 upper left column last line and p.30 upper right column line 6 to p.35 lower right column line 11 | p.4 lines 15 to 27, p.5 line 30 to p.28 last line, p.45 lines 29 to 31 and p.47 line 23 to p.63 line 50 |
| Color Formation-strengthen agent | p.121 upper left column line 7 to p.125 upper right column line 1 | — | — |
| Ultra violet absorbent | p.125 upper right column line 2 to p.127 lower left column last line | p.37 lower right column line 14 to p.38 upper left column line 11 | p.65 lines 22 to 31 |
| Discoloration inhibitor (Image-dye stabilizer) | p.127 lower right column line 1 to p.137 lower left column line 8 | p.36 upper right column line 12 to p.37 upper left column line 19 | p.4 line 30 to p.5 line 23, p.29 line 1 to p.45 line 25 p.45 lines 33 to 40 and p.65 lines 2 to 21 |
| High-boiling | p.137 lower left column | p.35 lower right column | p.64 lines 1 to 51 |

-continued

| Element constituting photographic material | Japanese Patent Application (OPI) No. Sho. 62-215272 | Japanese Patent Application (OPI) Hei. 2-33144 | EP 0,355,660A2 |
|---|---|---|---|
| and/or low-boiling solvent | line 9 to p.144 upper right column last line | line 14 to p.36 upper left column line 4 | |
| Method for dispersing additives for photograph | p.144 lower left column line 1 to p.146 upper right coulumn line 7 | p.27 lower right column line 10 to p.28 upper left column last line and p.35 lower right column line 12 to p.36 upper right column line 7 | p.63 line 51 to p.64 line 56 |
| Film Hardener | p.146 upper right column line 8 to p.155 lower left column line 4 | — | — |
| Developing Agent precursor | p.155 lower left column line 5 to p.155 lower right column line 2 | — | — |
| Compound releaing development restrainer | p.155 lower right column lines 3 to 9 | — | — |
| Base | p.155 lower right column line 19 to p.156 upper left column line 14 | p.38 upper right column line 18 to p.39 upper left column line 3 | p.66 line 29 to p.67 line 13 |
| Constitution of photosensitive layer | p.156 upper left column line 15 to p.156 lower right column line 14 | p.28 upper right column lines 1 to 15 | p.45 lines 41 to 52 |
| Dye | p.156 lower right column line 15 to p.184 lower ringt column last line | p.38 upper left column line 12 to upper right column line 7 | p.66 lines 18 to 22 |
| Color-mix inhibitor | p.185 upper left column line 1 to p.188 lower right column line 3 | p.36 upper right column lines 8 to 11 | p.64 line 57 to p.65 line 1 |
| Gradation controller | p.188 lower right column lines 4 to 8 | — | — |
| Stain inhibitor | p.188 lower right column line 9 to p.193 lower right column line 10 | p.37 upper left column last line to lower right column line 13 | p.65 line 32 to p.66 line 1 |
| Surface-active agent | p.201 lower left column line 1 to p.210 upper right column last line | p.18 upper right column line 1 to p.24 lower right column last line and p.27 lower left column line 10 from the botom to lower right column line 9 | — |
| Fluorine-containing agent (As Antistatic agent, coating aid, lubricant, adhesion inhibitor, or the like) | p.210 lower left column line 1 to p.222 lower left column line 5 | p.25 upper left column line 1 to p.27 lower right column line 9 | — |
| Binder (Hydrophilic colloid) | p.222 lower left column line 6 to p.225 upper left column last line | p.38 upper right column lines 8 to 18 | p.66 lines 23 to 28 |
| Thickening agent | p.225 upper right column line 1 to p.227 upper right column line 2 | — | — |
| Antistatic agent | p.227 upper right column line 3 to p.230 upper left column line 1 | — | — |
| Polymer latex latex | p.230 upper left column line 2 to p.239 last line | — | — |
| Matting agent | p.240 upper left column line 1 to p.240 upper right column last line | — | — |
| Photographic processing method (processing process, additive, etc.) | p.3 upper right column line 7 to p.10 upper right column line 5 | p.39 upper left column line 4 to p.42 upper left column last line | p.67 line 14 to p.69 line 28 |

Note: In the cited part of Japanese Patent Application (OPI) No. Sho. 62-21572, amendment filed on Showa 62 March 16, is included. Further, among the above-mentioned couplers, it is preferred to use so-called short wavelength-type yellow coupler, described in Japanese Patent Application (OPI) Nos. Sho. 63-231451, Sho. 63-123047, Sho. 63-241547, Hei. 1-173499, Hei. 1-213648, and Hei. 1-250944, as a yellow coupler.

Further, as cyan couplers, diphenylimidazole cyan couplers described in Japanese Patent Application (OPI) No. Hei. 2-33144, as well as 3-hydroxypyridine cyan dye-forming couplers described in European Patent EP 0,333,185A2 (in particular one obtained by causing Coupler (42), which is a four-equivalent coupler, to have a chlorine coupling split-off group, thereby rendering it to two-equivalent, and Couplers (6) and (9), which are listed as specific examples, are preferable) and cyclic active methylene cyan dye-forming couplers described in Japanese Patent Application (OPI) No. Hei. 2-32260 (in particular, specifically listed Coupler Examples 3, 8, and 34 are preferable) are preferably used.

As a method for color development processing of a photographic material using a high-silver-chloride emulsion, the method described in, for example, Japanese Patent Application (OPI) No. Hei. 2-207250, page 27 (the left upper column) to page 34 (the right upper column), is preferably used.

According to the present color photographic material and the present method for forming a color image using the same, a stable method for forming an image can be provided wherein, even by high-intensity short-time exposure, such as scanning exposure using semiconductor lasers, rapid processing is possible, an image high in sensitivity and contrast can be obtained, and the change in sensitivity due to a change in temperature at the time of exposure is less.

According to the present invention, a simple and stable system that can output an image based on digital information can designed.

The present invention will now specifically be described with reference to Examples, but the present invention is not limited to them.

EXAMPLE 1

6.4 g of sodium chloride was added to a 3% aqueous lime-processed gelatin solution, and then 3.2 ml of N,N'-dimethylimidazolidine-2-thione (a 1% aqueous solution) was added thereto. An aqueous solution containing 0.2 mol of silver nitrate and an aqueous solution containing 0.08 mol of potassium bromide and 0.12 mol of sodium chloride were violently stirred into the resulting solution at 52° C., followed by mixing. Then an aqueous solution containing 0.6 mol of silver nitrate and an aqueous solution containing 0.24 mol of potassium bromide and 0.36 mol of sodium chloride were violently stirred thereinto at 52° C., followed by mixing. Then an aqueous solution containing 0.2 mol of silver nitrate and an aqueous solution containing 0.08 mol of potassium bromide, 0.12 mol of sodium chloride, and 0.04 mg of potassium hexachloroiridate(IV) were stirred thereinto at 52° C., followed by mixing. After the mixture was retained at 52° C. for 5 min, desalting and washing were carried out. Further, 90.0 g of lime-processed gelatin was added, then triethyl thiourea and a nucleic acid were added, and chemical sensitization and spectral sensitization were carried out optimally. The obtained silver bromochloride (silver bromide: 40 mol %) emulsion was named Emulsion A.

Then, 3.3 g of sodium chloride was added to a 3% aqueous lime-processed gelatin solution, and then 3.2 ml of N,N'-dimethylimidazolidine-2-thione (a 1% aqueous solution) was added. An aqueous solution containing 0.2 mol of silver nitrate and an aqueous solution containing 0.2 mol of sodium chloride were violently stirred into the resulting solution at 52° C., followed by mixing. Then an aqueous solution containing 0.6 mol of silver nitrate and an aqueous solution containing 0.6 mol of sodium chloride were violently stirred thereinto at 52° C., followed by mixing. Then an aqueous solution containing 0.2 mol of silver nitrate and an aqueous solution containing 0.2 mol of sodium chloride were violently stirred thereinto at 52° C., followed by mixing. After the mixture was retained at 52° C. for 5 min, desalting and washing were carried out. Further, 90.0 g of lime-processed gelatin was added, then a finely divided silver bromide emulsion (having an average grain size of 0.05 μm and containing $1.5\times10^{-4}$ mol of potassium hexachloroiridate(IV) per mol of the silver bromide) corresponding to 1.2 mol % for the silver halide, triethyl thiourea, and a nucleic acid were added, and chemical sensitization was carried out optimally. The thus obtained silver chloride emulsion was named Emulsion B.

Next the procedure for the preparation of Emulsion B was repeated, except that 132.8 mg, 398.4 mg, and 132.8 mg of potassium iodide were added respectively to the aqueous sodium chloride solutions that were added when the grains were formed, thereby preparing an emulsion that was named Emulsion C.

The procedure for the preparation of Emulsion B was repeated, except that 0.84 mg, 2.53 mg, and 0.84 mg of potassium hexacyanoferrate(II) trihydrate were added respectively to the aqueous sodium chloride solutions that were added when the grains were formed, thereby preparing an emulsion that was named Emulsion D.

The procedure for the preparation of Emulsion B was repeated, except that 664.0 mg of potassium iodide was added to the third aqueous sodium chloride solution that was added when the grains were formed, thereby preparing an emulsion that was named Emulsion E.

The procedure for the preparation of Emulsion B was repeated, except that 4.22 mg of potassium hexacyanoferrate(II) trihydrate was added to the third aqueous sodium chloride solution that was added when the grains were formed, thereby preparing an emulsion that was named Emulsion F.

The procedure for the preparation of Emulsion D was repeated, except that 132.8 mg, 398.4 mg, and 132.8 mg of potassium iodide were added respectively to the aqueous sodium chloride solutions that were added when the grains were formed, thereby preparing an emulsion that was named Emulsion G.

Next the procedure for the preparation of Emulsion F was repeated, except that 664.0 mg of potassium iodide was added to the third aqueous sodium chloride solution that was added when the grains were formed, thereby preparing an emulsion that was named Emulsion H.

The sizes of the silver halide grains contained in the thus prepared eight emulsions were approximately the same, the silver halide grains were cubes having an average edge length of 0.51 μm, and the deviation coefficient of the grain sizes was 0.08.

The halogen compositions of these emulsions and the presence or absence of silver iodide or an iron compound in the grains thereof are summarized in Table 1.

TABLE 1

| Emulsion | Halide composition | Silver iodide | Iron compound |
|---|---|---|---|
| A | $AgCl_{60}Br_{40}$ | None | None |
| B | $AgCl_{98.8}Br_{1.2}$ | None | None |
| C | $AgCl_{98.4}Br_{1.2}I_{0.4}$ | $4\times10^{-3}$ mol/mol Ag (contained uniformly) | None |
| D | $AgCl_{98.8}Br_{1.2}$ | None | Potassium hexacyanoferrate(II) (Contained uniformly) $1\times10^{-5}$ mol/mol Ag |
| E | $AgCl_{98.4}Br_{1.2}I_{0.4}$ | $4\times10^{-3}$ mol/mol Ag (contained in surface layer of 20%) | None |
| F | $AgCl_{98.8}Br_{1.2}$ | None | Potassium hexacyanoferrate(II) (contained in surface layer of 20%) $1\times10^{-5}$ mol/mol Ag |
| G | $AgCl_{98.4}Br_{1.2}I_{0.4}$ | $4\times10^{-3}$ mol/mol Ag | Potassium hexacyanoferrate(II) |

TABLE 1-continued

| Emulsion | Halide composition | Silver iodide | Iron compound |
|---|---|---|---|
| | | (contained uniformly) | (contained uniformly) |
| H | $AgCl_{98.4}Br_{1.2}I_{0.4}$ | $4 \times 10^{-3}$ mol/mol Ag (contained in surface layer of 20%) | $1 \times 10^{-5}$ mol/mol Ag Potassium hexacyanoferrate(II) (contained in surface layer of 20%) $1 \times 10^{-5}$ mol/mol Ag |

Multilayer color photographic materials were prepared by combination of the thus-obtained eight emulsions. The combination of emulsion and spectral sensitizing dye are shown in Table 2.

TABLE 2

| Sample | Yellow color-forming-layer | Magenta color-forming layer | Cyan color-forming layer |
|---|---|---|---|
| 101 | Emulsion F/Dye 1 | Emulsion F/Dye 2 | Emulsion A/Dye 3 |
| 102 | Emulsion F/Dye 1 | Emulsion F/Dye 2 | Emulsion B/Dye 3 |
| 103 | Emulsion F/Dye 1 | Emulsion F/Dye 2 | Emulsion C/Dye 3 |
| 104 | Emulsion F/Dye 1 | Emulsion F/Dye 2 | Emulsion D/Dye 3 |
| 105 | Emulsion F/Dye 1 | Emulsion F/Dye 2 | Emulsion E/Dye 3 |
| 106 | Emulsion F/Dye 1 | Emulsion F/Dye 2 | Emulsion F/Dye 3 |
| 107 | Emulsion F/Dye 1 | Emulsion F/Dye 2 | Emulsion G/Dye 3 |
| 108 | Emulsion F/Dye 1 | Emulsion F/Dye 2 | Emulsion H/Dye 3 |

With respect to the preparation of multilayer color photographic material, paper support laminated on both sides thereof with polyethylene film was subjected to a corona discharge treatment on the surface, and then provided a gelatin prime coat-layer containing sodium dodecylbenzenesulfonate, further coated various photographic constituting layers, thereby preparing a multilayer color photographic material having layer compositions shown below. Coating solutions were prepared as follows:

Preparation of the first layer coating solution

To a mixture of 19.1 g of yellow coupler (ExY), 4.4 g of image-dye stabilizer (Cpd-1), and 0.7 g of image-dye stabilizer (Cpd-7) were added and dissolved 27.2 ml of ethyl acetate and each 4.1 g of solvent (Solv-3) and solvent (Solv-7). The resulting solution was dispersed and emulsified in 185 ml of 10% aqueous gelatin solution containing 8 ml of sodium dodecylbenzenesulfonate, thereby preparing emulsified dispersion. Separately, an emulsion was prepared by adding a red-sensitive sensitizing dye (Dye-1), shown below to a silver chlorobromide emulsion (see Table 2). The above-described emulsified dispersion and this emulsion were mixed together and dissolved to give the composition shown below, thereby preparing the first layer coating solution.

Coating solutions for the second to the seventh layer were also prepared in the same manner as the first layer coating solution. As a gelatin hardener for the respective layers, 1-oxy-3,5-dichloro-s-triazine sodium salt was used.

Further, Cpd-10 and Cpd-11 were added to each layer in such a manner that the total amount was 25.0 mg/m$^2$ and 50 mg/m$^2$, respectively.

The added amounts of Dye-1, Dye-2, and Dye-3 were as shown below.

Dye-1
(First layer: red-sensitive yellow color-forming layer)

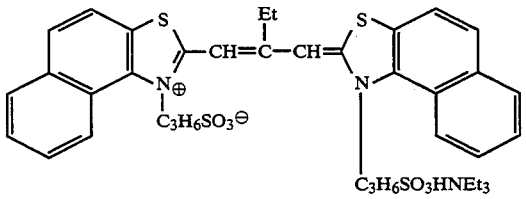

$1.0 \times 10^{-4}$ mol per mol of silver halide

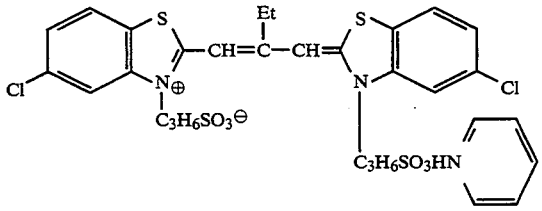

$1.0 \times 10^{-4}$ mol per mol of silver halide

Dye-2
(Third layer: infrared-sensitive magenta color-forming layer)

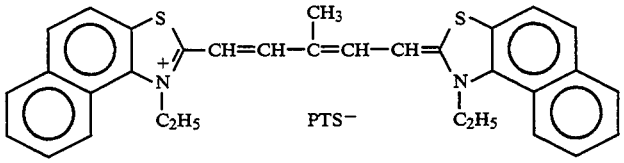

-continued $4.5 \times 10^{-5}$ mol per mol of silver halide

Dye-3

(Fifth layer: infrared-sensitive cyan color-forming layer)

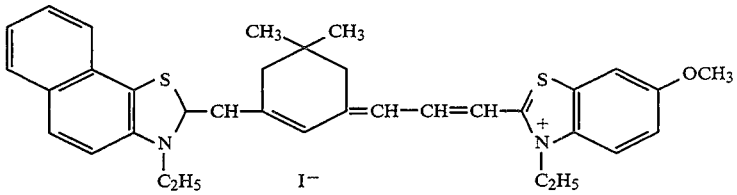

$0.5 \times 10^{-5}$ mol per mol of silver halide

To the magenta color-forming layer and the cyan color-forming layer, the following compound was added in an amount of $1.8 \times 10^{-3}$ mol per mol of silver halide, respectively:

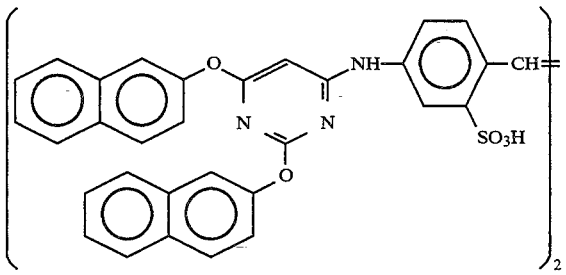

Further, 1-(5-methylureidophenyl)-5-mercaptotetrazole was added to the yellow color-forming emulsion layer, the magenta color-forming emulsion layer, and the cyan color-forming emulsion layer, in amount of $8.0 \times 10^{-4}$ mol per mol of silver halide, respectively. Further, the following compound was added to the magenta color-forming layer and the cyan color-forming layer, in amount of $2.0 \times 10^{-3}$ mol per mol of silver halide, respectively.

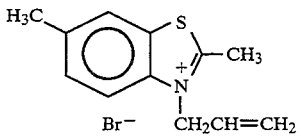

The dyes shown below were added to the emulsion layers for prevention of irradiation.

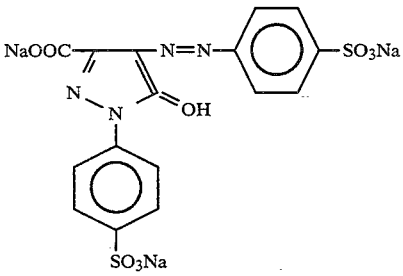

(10 mg/m²)

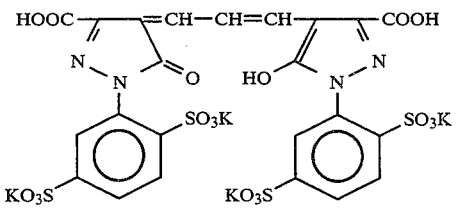

(10 mg/m²)

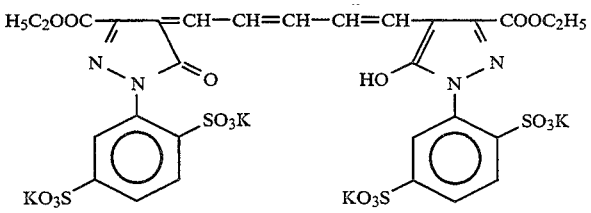

(40 mg/m²)

-continued

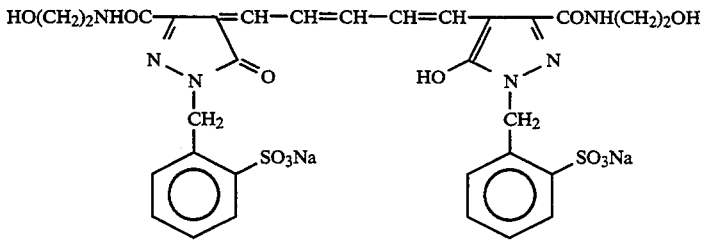

(20 mg/m²)

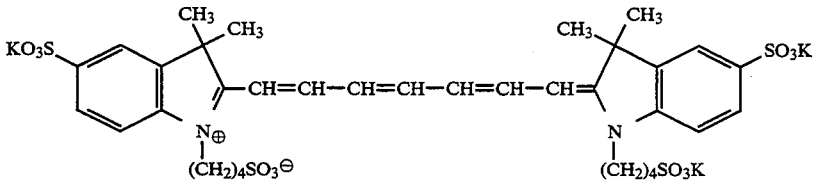

(10 mg/m²)

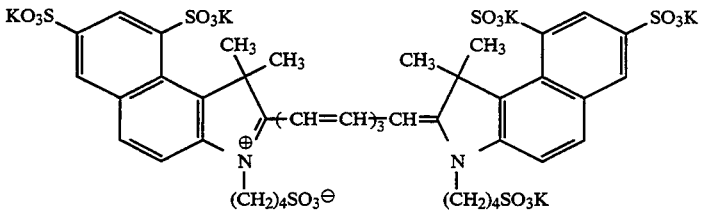

(5 mg/m²)

and

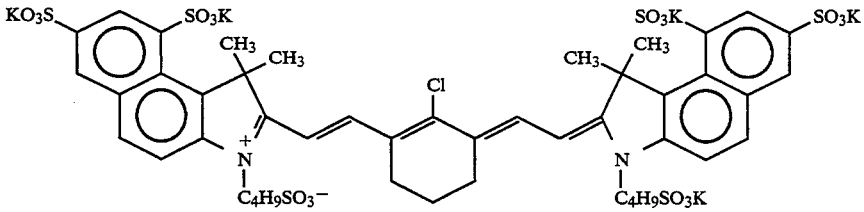

(5 mg/m²)

(Composition of Layers)

The composition of each layer is shown below. The figures represent coating amount (g/m²). The coating amount of each silver halide emulsion is given a value in terms of silver.

| | |
|---|---|
| Support | |
| Paper laminated on both sides with polyethylene [a white pigment ($TiO_2$) and a bluish dye (ultra-marine) were included in the first layer side of the polyethylene-laminated film] | |
| First Layer (Red-sensitive yellow color-forming layer) | |
| The above described silver chlorobromide emulsion (See TABLE 2) | 0.30 |
| Gelatin | 1.22 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second Layer (Color-mix preventing layer) | |
| Gelatin | 0.64 |
| Color-mix inhibitor (Cpd-5) | 0.10 |
| Solvent (Solv-1) | 0.16 |
| Solvent (Solv-4) | 0.08 |
| Third Layer (Infrared-sensitive magenta color-forming layer) | |
| Silver chlorobromide emulsion (see TABLE 2) | 0.12 |
| Gelatin | 1.28 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet rays-absorbing layer) | |
| Gelatin | 1.41 |
| Ultraviolet-absorber (UV-1) | 0.47 |
| Color-mix inhibitor (Cpd-5) | 0.05 |
| Solvent (Solv-5) | 0.24 |

-continued

| | |
|---|---|
| Fifth Layer (Infrared-sensitive cyan color-forming layer) | |
| Silver chlorobromide emulsion (see TABLE 2) | 0.23 |
| Gelatin | 1.04 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet rays-absorbing layer) | |
| Gelatin | 0.48 |
| Ultraviolet absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.10 |
| Acryl-modified copolymer of polyvinyl alcohol (modification degree: 17%) | 0.17 |
| Liquid paraffin | 0.03 |

(ExY) Yellow coupler
1:1 Mixture (in molar ratio) of

R = 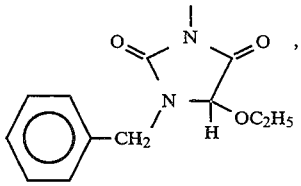 , X = Cl and

R = 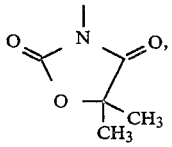 X = $OCH_3$ of

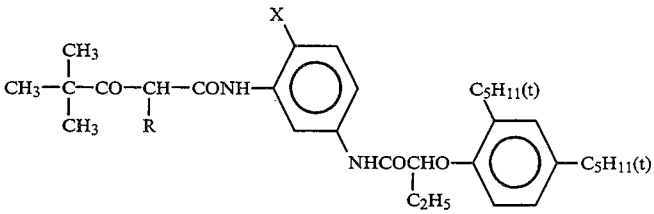

(ExM) Magenta coupler

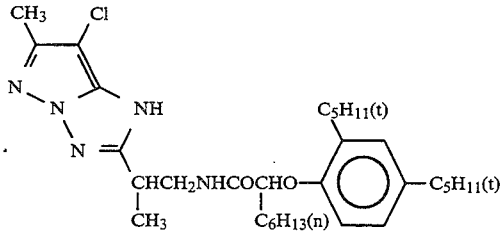

(ExC) Cyan coupler
1:1 Mixture (in molar ratio) of

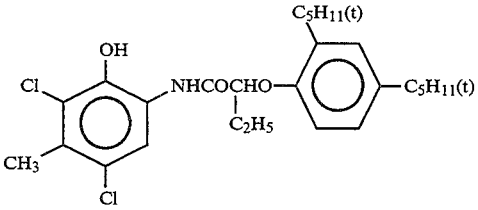

and

-continued
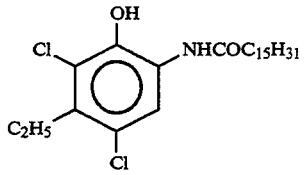
(Cpd-1) Image-dye stabilizer
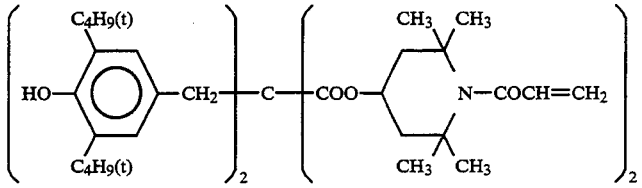
(Cpd-2) Image-dye stabilizer
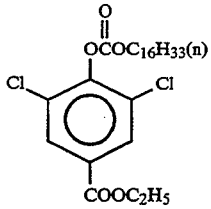
(Cpd-3) Image-dye stabilizer
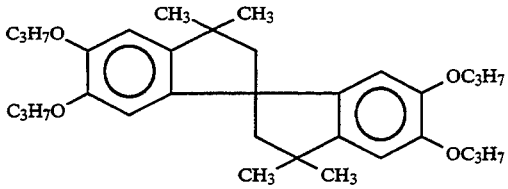
(Cpd-4) Image-dye stabilizer
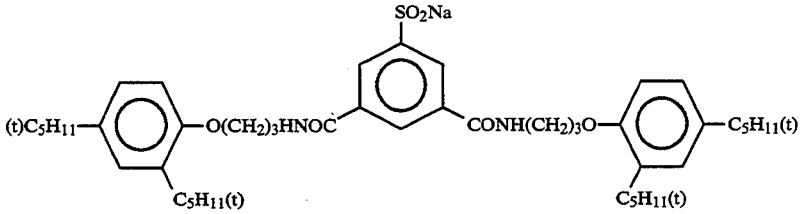
(Cpd-5) Color-mix inhibitor
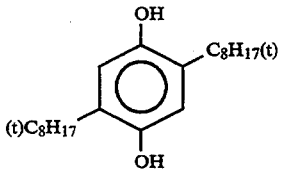
(Cpd-6) Image-dye stabilizer
2:4:4 Mixture (in weight ratio) of
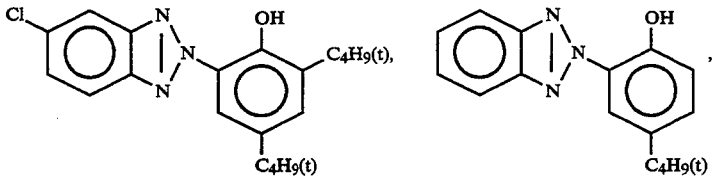
and -continued
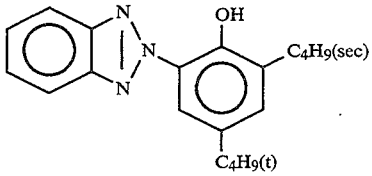
(Cpd-7) Image-dye stabilizer
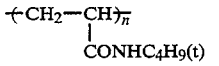
Average molecular weight: 60,000
(Cpd-8) Image-dye stabilizer
1:1 Mixture (in weight ratio) of
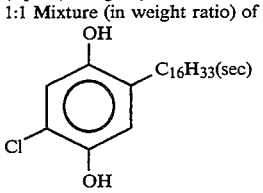
and
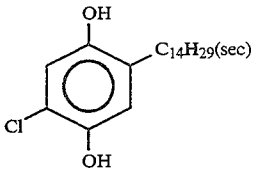
(Cpd-9) Image-dye stabilizer
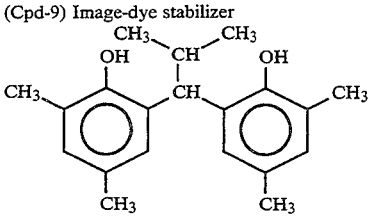
(Cpd-10) Antiseptic
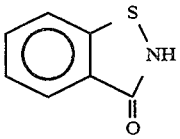
(Cpd-11) Antiseptic
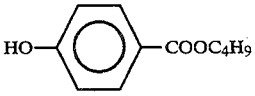
(UV-l) Ultraviolet ray absorber
4:2:4 Mixture (in weight ratio) of
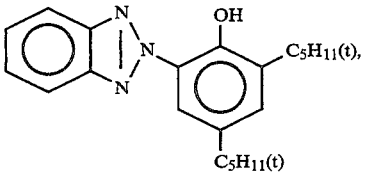
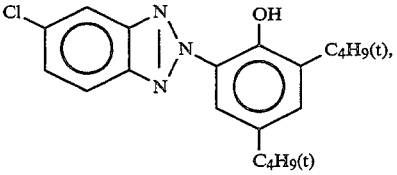
and
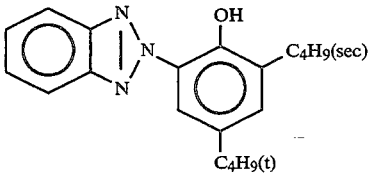
(Solv-1) Solvent
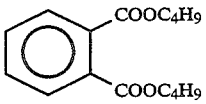

-continued (Solv-2) Solvent
1:1: Mixture (in volume ratio) of

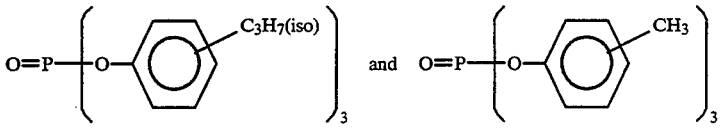

(Solv-3) Solvent
$O{=}P{-}(O{-}C_9H_{19}(iso))_3$ (Solv-4) Solvent

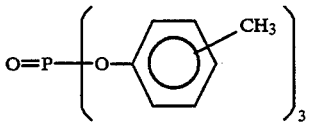

(Solv-5) Solvent
$(COOC_8H_{17})_2(CH_2)_8$ (Solv-6) Solvent
80:20 Mixture (in volume ratio) of

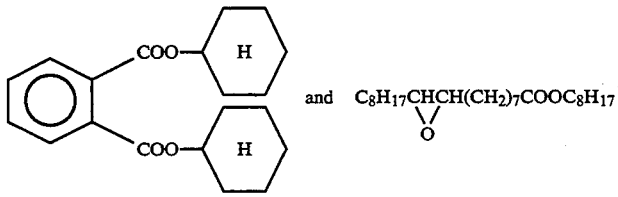

(Solve-7) Solvent
$C_8H_{17}\underset{O}{CHCH}(CH_2)_7COOC_8H_{17}$

The thus prepared eight coated samples were used to test the performance of each of the emulsions.

Each of the samples was exposed to light of 30,000 CMS for 1 sec using a sensitometer (FWH model, manufactured by Fuji Photo Film Co., Ltd.; the color temperature of the light source: 3,200K) at room temperature (24° C.) through an optical wedge and an interference filter that transmits red light of 820 nm to 840 nm, followed by color development processing using the below-mentioned developing steps and developer. At that time, to evaluate the rapid processability, the development time was 20 sec, and also 45 sec for comparison.

The reflection density of the cyan color-formed image of each of the thus prepared processed samples was determined, to obtain the so-called characteristic curve. From these characteristic curves, the fogging density, the relative sensitivity, and the contrast were found. The relative sensitivity was expressed in terms of a relative value by assuming the reciprocal of the exposure amount that gave a density 0.5 higher than the fogging density to be the sensitivity, and designating the sensitivity of Sample 101, which had been processed for 45 sec, as 100. The contrast was expressed in terms of an increment of the color density at the time when the exposure amount was increased by 0.5 log E from the point where the sensitivity was found.

Then, in order to know how the photographic performance changes when the temperature of the sample at the time of exposure changes, each of the samples was subjected to exposure of 30,000 CMS for 1 sec at temperatures of 15° C. and 35° C., and 30 sec after the exposure the samples were developed. From the obtained characteristic curves, the sensitivity fluctuation for a change in temperature was expressed in terms of log E units by finding the difference of the exposure amount that gave a density 1.0 higher than the fogging density.

Further, an exposure pattern for sensitometry was given by using scanning exposure by a semiconductor laser to test the photographic performance. As the light source, a semiconductor laser GaAlAs (emission wavelength: about 830 nm) was used. The emitted laser beam was scanned by a rotating polyhedron, and scanning exposure was successively given onto the sample moved vertically to the scanning direction. A combination of a pulse width modulation system, for modulating the amount of light by changing the time of passage of the electricity to the semiconductor laser, with an intensity modulation system, for modulating the amount of light by changing the amount of electricity, was used for the amount of light of the semiconductor laser to control the exposure amount. At that time, the scanning exposure was carried out with 400 dpi, and the average exposure time per picture element was about $10^{-7}$ sec at that time. 30 sec after the exposure, the exposed sample was subjected to color development processing using the same processing steps and processing solution as those for the previous samples, and then the reflection density of the cyan color-formed image was determined, to obtain the characteristic curve. From these characteristic curves, the relative sensitivity and the contrast were found. The relative sensitivity was expressed in terms of a relative value by assuming the reciprocal of the exposure amount that gave a density 0.5 higher than the fogging density to be the sensitivity, and designating the sensitivity of Sample 101 as 100. The contrast was expressed in terms of an increment of the color density at the time when the exposure amount was increased by 0.5 log E from the point where the sensitivity was found.

Then, in order to know how the photographic performance changes when the temperature of the sample at the time of exposure changes, each of the samples was subjected to scanning exposure similarly at temperatures of 15° C. and 35° C., and 30 sec after the exposure the samples were developed. From the obtained characteristic curves, the sensitivity fluctuation for a change in temperature was expressed in terms of log E units by finding the difference of the exposure amount that gave a density 1.0 higher than the fogging density.

TABLE 3

| Sample | Room Temperature (24° C.) Exposure to light in 1 sec: Development in 20 sec: Fogging | Sensitivity | Contrast | Development in 45 sec: Fogging | Sensitivity | Contrast | Difference of sensitivity between 15° C. exposure and 35° C. exposure, to light in 1 sec Difference of exposure amount to give a reflect density of fogging + 1.0 (log E) | Room temperature (24° C.) scanning exposure, development in 45 sec: Sensitivity | Contrast | Difference of sensitivity between 15° C. exposure and 35° C. exposure, scanning exposure Difference of exposure amount to give a reflect density of fogging + 1.0 (log E) |
|---|---|---|---|---|---|---|---|---|---|---|
| 101 | 0.08 | 24 | 0.32 | 0.09 | 100 | 0.68 | 0.09 | 100 | 0.47 | 0.16 |
| 102 | 0.08 | 68 | 1.37 | 0.10 | 108 | 1.39 | 0.28 | 89 | 1.05 | 0.35 |
| 103 | 0.09 | 97 | 1.45 | 0.12 | 137 | 1.47 | 0.19 | 141 | 1.42 | 0.23 |
| 104 | 0.08 | 119 | 1.44 | 0.09 | 182 | 1.46 | 0.16 | 179 | 1.41 | 0.24 |
| 105 | 0.11 | 185 | 1.51 | 0.18 | 251 | 1.55 | 0.14 | 275 | 1.54 | 0.19 |
| 106 | 0.08 | 279 | 1.50 | 0.09 | 424 | 1.53 | 0.11 | 437 | 1.48 | 0.20 |
| 107 | 0.08 | 224 | 1.56 | 0.10 | 299 | 1.59 | 0.07 | 326 | 1.56 | 0.06 |
| 108 | 0.08 | 451 | 1.59 | 0.10 | 643 | 1.62 | 0.04 | 738 | 1.60 | 0.05 |

Note: Samples 101~107 are for comparison, Sample 108 is this invention.

| Processing step | Temperature | Processing Time | Replenisher amount (per 1 $m^2$ of photographic material) |
|---|---|---|---|
| Color developing | 38.5° C. | 20 sec, 45 sec | 35 ml |
| Bleach-fixing | 38° C. | 20 sec | 35 ml |
| Rinse ① | 38° C. | 12 sec | |
| Rinse ② | 38° C. | 12 sec | |
| Rinse ③ | 38° C. | 12 sec | 105 ml |
| Drying | 650C | 15 sec | |

(3-Tanks countercurrent mode rinse ③ → ① was used)

| Color-developer | Tank Solution | Replenisher |
|---|---|---|
| Water | 700 ml | 700 ml |
| Sodium triisopropylnaphthalene(β)-sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Sodium chloride | 6.5 g | None |
| Potassium bromide | 0.03 g | None |
| Potassium carbonate | 27.0 g | 27.0 g |
| Sodium sulfite | 0.1 g | 0.1 g |
| Disodium-N,N-bis(sulfonatoethyl)-hydroxylamine | 10.0 g | 13.0 g |
| N-ethyl-N-(β-methanesulfonamidoethyl)-3-methyl-4-aminoaniline sulfate | 5.0 g | 11.5 g |
| Fluorescent whitening agent (made by Ciba Geigy) UVITEX-CK | 2.0 g | 6.5 g |
| Water to make 1000 ml pH (25° C.) | 10.05 | |
| Bleach-fixing solution (Both tank solution and replenisher) | | |
| Water | 400 ml | |
| Ammonium thiosulfate (700 g/l) | 100 ml | |
| Sodium sulfite | 17.0 g | |
| Iron (III) ammonium ethylenediaminetetraacetate | 55.0 g | |
| Disodium ethylenediaminetetraacetate | 5.0 g | |
| Ammonium bromide | 40.0 g | |
| Water to make 1000 ml pH (25°) | 6.0 | |
| Rinse solution (Both tank solution and replenisher) | | |
| Ion-exchanged water (calcium and magnesium each are 3 ppm or below) | | |

From the results, a remarkable effect of the present invention can be understood. That is, in Sample 101, which used in the cyan color-forming layer an emulsion having a silver bromide content of 40 mol %, when the temperature changes at the time of exposure, the sensitivity changes less, but the development is slow and the sensitivity and contrast obtained by the tested processing time are extremely low, so that it cannot be used in practice.

In Sample 102, which used in the cyan color-forming layer an emulsion having a silver chloride content of 98.8 mol %, the development speed becomes remarkably high and a high contrast can be obtained even by rapid processing, but the sensitivity is low and it cannot be used in practice. Further, the sensitivity fluctuation due to a change in temperature at the time of exposure is extremely large. The sensitivity and the contrast obtained by scanning exposure using a semiconductor laser are low.

In contrast, in Sample 103, which used in the cyan color-forming layer a silver chloride emulsion containing a trace amount of silver iodide, although it is observed that the sensitivity is increased and the sensitivity fluctuation due to a change in temperature at the time of exposure is lessened, the fogging is increased a little. This is more conspicuous in Sample 105, which used in the cyan color-forming layer an emulsion wherein silver iodide was concentrated in the surface layer corresponding to 20% of the silver halide grains.

On the other hand, in Sample 104, which used in the cyan color-forming layer a silver chloride emulsion containing potassium hexacyanoferrate(II), and in Sample 106, which used in the cyan color-forming layer an emulsion wherein an iron compound was concentrated in the surface layer corresponding to 20% of the silver halide grains, although an increase in sensitivity and an increase in contrast are observed, there is a problem because the dependency on exposure temperature is high in scanning exposure that used a semiconductor laser. In Sample 108, which used in the cyan color-forming layer a high-silver chloride emulsion containing silver iodide and an iron compound near the surface of the silver halide grains, as in the emulsion of the present invention, a high sensitivity and a high contrast are obtained and the fluctuation in sensitivity due to a change in temperature at the time of exposure is remarkably suppressed. This effect is more remarkable in high-intensity short-time exposure, such as scanning exposure that used a semiconductor laser.

EXAMPLE 2

An emulsion was prepared by changing the amount of the potassium hexachynoferrate(II) to 42.2 mg in the procedure for Emulsion H in Example 1, and by optimally chemical sensitization, which was named Emulsion I.

Then six multi-layer color photographic materials were prepared in the same manner as in Example 1, except that Emulsion I and Emulsions F and H prepared in Example 1 were used, and spectrally sensitizing dyes were used in combination therewith, as shown in Table 4.

TABLE 4

| Sample | Yellow color-forming layer | Magenta color-forming layer | Cyan color-forming layer |
|---|---|---|---|
| 201 | Emulsion F/Dye 1 | Emulsion F/Dye 2 | Emulsion F/Dye 3 |
| 202 | Emulsion F/Dye 1 | Emulsion F/Dye 2 | Emulsion H/Dye 3 |
| 203 | Emulsion F/Dye 1 | Emulsion H/Dye 2 | Emulsion H/Dye 3 |
| 204 | Emulsion F/Dye 1 | Emulsion H/Dye 2 | Emulsion H/Dye 3 |
| 205 | Emulsion F/Dye 1 | Emulsion H/Dye 2 | Emulsion I/Dye 3 |
| 206 | Emulsion F/Dye 1 | Emulsion I/Dye 2 | Emulsion I/Dye 3 |

The amounts of the spectrally sensitizing dyes per mol of the silver halide were the same as those in Example 1.

These photographic materials were subjected to scanning exposure by semiconductor lasers that emit lights having wavelengths corresponding to the spectral sensitivity distributions of the respective layers. The exposure was carried out using the same scanning exposure as that in Example 1, to give an exposure pattern for sensitivity. As the light sources, a semiconductor laser AlGaInP (emitting wavelength: about 670 nm), a semiconductor laser GaAlAs (emitting wavelength: about 750 nm), and a semiconductor laser GaAlAs (emitting wavelength: about 830 nm) were used. The system of scanning the emitted laser beam was the same as in Example 1. 30 sec after the exposure, the exposed samples were subjected to color development processing using the processing steps and processing solutions shown below, then the reflection densities of the yellow color-formed image, the magenta color-formed image, and the cyan color-formed image were determined, and the characteristic curves were formed. Similarly to Example 1, the relative sensitivity and the contrast were measured. The relative sensitivity was expressed in terms of a relative value assuming the sensitivity of each of the layers of Sample 210 to be 100.

Then, as same as in Example 1, in order to know how the photographic performance changes when the temperature of the sample at the time of exposure changes, each of the samples was subjected to scanning exposure similarly at temperatures of 15° C., and 30 sec after the exposure the samples were developed. From the obtained characteristic curves, the sensitivity fluctuation for a change in temperature was expressed in terms of log E units by finding the difference of the exposure amount tat gave a density 1.0 higher than the fogging density.

Results obtained are summarized in Table 5.

TABLE 5

| | Room Temperature (24° C.) scanning exposure, development in 20 sec | | | | | | Difference of sensitivity between 15° C. exposure and 35° C. exposure, scanning exposure, Difference of exposure amount to give a reflect density of fogging + 1.0 (log E) | | | |
|---|---|---|---|---|---|---|---|---|---|---|
| | Yello color-forming layer | | Magenta color-forming layer | | Cyan color-forming layer | | | | | |
| Sample | Sensitivity | Contrast | Sensitivity | Contrast | Sensitivity | Contrast | Yellow color-forming layer | Magent color-forming layer | Cyan color-forming layer | Remarks |
| 201 | 100 | 1.36 | 100 | 1.51 | 100 | 1.47 | 0.06 | 0.14 | 0.21 | Comparison |
| 202 | 99 | 1.35 | 101 | 1.49 | 171 | 1.61 | 0.05 | 0.13 | 0.05 | This invention |
| 203 | 101 | 1.37 | 199 | 1.65 | 173 | 1.62 | 0.05 | 0.03 | 0.04 | This invention |
| 204 | 174 | 1.51 | 198 | 1.67 | 172 | 1.60 | 0.02 | 0.04 | 0.05 | This invention |
| 205 | 175 | 1.50 | 197 | 1.66 | 205 | 1.66 | 0.03 | 0.03 | 0.03 | This invention |
| 206 | 175 | 1.51 | 226 | 1.70 | 207 | 1.68 | 0.02 | 0.02 | 0.03 | This invention |

| Processing process | Developing Prosess (II) | |
|---|---|---|
| Color developing | 38° C. | 20 sec |
| Bleach-fixing | 38° C. | 20 sec |
| Rinse ① | 38° C. | 7 sec |
| Rinse ② | 38° C. | 7 sec |
| Rinse ③ | 38° C. | 7 sec |
| Rinse ④ | 38° C. | 7 sec |
| Rinse ⑤ | 38° C. | 7 sec |
| Drying | 65° C. | 15 sec |

(5-tanks countercurrent flow mode of rinse ⑤ → ① was used.)

(Above-described processing time of each process means a value between the time when the photographic material comes into one of processing solution and the time when it comes into next processing solution including the time in the air after it comes out of the former solution. Although the ratio of time in the air to the processing time varies usually depending on the scale of processor, the ratio in Example of the present invention was in the range of 5% to 40%.)

Compositions of each processing solution were as follows:

| Color-developer | Tank Solution | Replenisher |
|---|---|---|
| Water | 700 ml | 700 ml |
| Sodium triisopropylnaphthalene(β)-sulfonate | 0.1 g | 0.1 g |

-continued

| Color-developer | Tank Solution | Replenisher |
|---|---|---|
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | None |
| Potassium bromide | 0.03 g | None |
| Sodium sulfite | 0.1 g | 0.1 g |
| Potassium carbonate | 27.0 g | 27.0 g |
| 4-Amino-N-ethyl-N-(3-hydroxypropyl)-3-methylaniline | 12.8 g | 27.0 g |
| Disodium-N,N-bis(sulfonatoethyl)-hydroxylamine | 10.0 g | 13.0 g |
| Fluorescent whitening agent (made by Ciba Geigy, UVITEX-CK) | 2.0 g | 6.5 g |
| Water to make | 1000 ml | 1000 ml |
| pH (25° C.) | 10.05 | 10.95 |

The replenishing amount of the above-described replenisher was 35 ml per $m^2$ of photographic material.

| Bleach-fixing solution | Tank Tank | Replenisher |
|---|---|---|
| Water | 400 ml | 400 ml |
| Ammonium thiosulfate (700 g/l) | 100 ml | 100 ml |
| Ethylenediaminetetraacetic acid | 3.4 g | 8.5 g |
| Iron (III) ammonium ethylenediamine-tetraacetate dihydrate | 73.0 g | 183 g |
| Ammonium sulfite | 40 g | 100 g |
| Ammonium bromide | 20.0 g | 50.0 g |
| Nitric acid (67%) | 9.6 g | 24 g |
| Water to make | 1000 ml | 1000 ml |
| pH (25°) | 5.80 | 5.10 |

The replenishing amount of the above-described replenisher was 35 ml per $m^2$ of photographic material. Rinse solution: In both tank solution and replenisher deionized water was used, and the replenisher amount was 60 ml/$m^2$.

From the results, it can be understood that the effect of the present invention is remarkable even when a rapid processing as short time as 90 seconds including drying process. Further, in the effect to give a high sensitivity and a high contrast, the emulsion of the present invention is more effective when it is used in a magenta color-forming layer or a cyan color-forming layer that was subjected to a spectral sensitization at infrared region than it was used in a yellow color-forming layer that was subjected to a spectral sensitization at red color region. Further, the effect to reduce the variation of sensitivity accompanying the change of temperature at exposure to light is exhibited more remarkable in a cyan color-forming layer sensitized by a sensitizing dye of longer wavelength.

Although the invention has been described in its preferred form with a certain degree of particularity, as many apparently widely different embodiments of this invention may be made without departing from the spirit and scope thereof, it is to be understood that the invention is not limited to the specific embodiments thereof except as defined in the appended claims.

What we claim is:

1. A silver halide color photographic material having photographic constitutional layers that comprise at least three photosensitive layers each containing respectively different dye-forming couplers and at least one non-photosensitive hydrophilic layer, on a support, wherein said three photosensitive layers have spectral sensitivity maxima in respectively different wavelength regions that are over 650 nm; the silver halide emulsion in these three photosensitive layers contain at least 96 mol % silver chloride, 0.01 to 3 mol % of silver iodide and an iron compound in an amount of $10^{-7}$ to $10^{-3}$ mol per tool of the silver halide, and 80% or more of the total content of each of the silver iodide and the iron compound is present in the surface layer corresponding to no greater than 50% of the volume of grains from the surface of said silver halide grains.

2. The silver halide color photographic material as claimed in claim 1, wherein the spectral sensitivity maxima of said three photosensitive layers are in the ranges of 650 to 690 nm, 720 to 790 nm, and 770 to 850 nm, respectively.

3. The silver halide color photographic material as claimed in claim 1, wherein the silver halide grains in the layer having a spectral sensitivity maximum at the longest wavelength out of said three photographic layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains.

4. The silver halide color photographic material as claimed in claim 1, wherein the silver halide grains in the layer having a spectral sensitivity maximum at the longest wavelength and the layer having a spectral sensitivity maximum at the next longest wavelength out of said three photographic layers contain 0.01 to 3 mol % of silver iodide and an iron compound in an amount of $10^{-7}$ to $10^{-3}$ mol per mol of the silver halide, and 80% or more of the total content of each of the silver iodide and the iron compound is present in the surface layer corresponding to no greater than 50% of the volume of grains from the surface of said silver halide grains.

5. The silver halide color photographic material as claimed in claim 1, wherein as the dye-forming couplers, at least one cyan dye-forming coupler, at least one magenta forming coupler, and at least one yellow dye-forming coupler are incorporated.

6. The silver halide color photographic material as claimed in claim 1, wherein any one of said photographic constitutional layers comprising three photosensitive layers and at least one non-photosensitive hydrophilic layer on the support further contains a compound represented by the following formula (Ia), (Ib), (Ic), or (Id);

Formula (Ia)

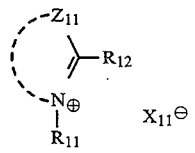

Formula (Ib)

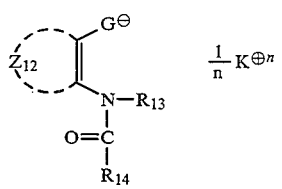

-continued

Formula (Ic)

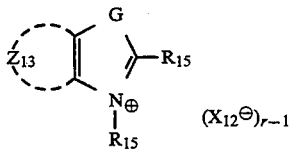

Formula (Id)

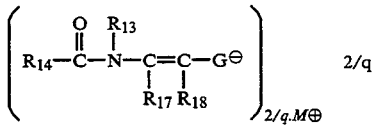

wherein $Z_{11}$ represents a group of non-metallic atoms required to complete a 5- or 6-membered nitrogen-containing heterocyclic ring; $Z_{12}$ and $Z_{13}$ each represent atoms required to complete an aromatic ring; $R_{11}$ represents a hydrogen atom, an alkyl group, or an alkenyl group; $R_{12}$ represents a hydrogen atom or a lower alkyl group; $R_{13}$ represents an alkyl group or en alkenyl group; $R_{15}$ represents a substituted alkyl group or a substituted alkenyl group wherein said alkyl group or alkenyl group is substituted with at least one member of the group consisting of carboxyl groups, sulfo groups, cyano groups, halogen atoms, hydroxyl groups, alkoxycarbonyl groups, alkoxy groups, aryloxy groups, acyloxy groups, acyl groups, carbamoyl groups, sulfamoyl groups and aryl groups; $R_{14}$ and $R_{16}$ each represent a hydrogen atom, an alkyl group, or an aryl group; $R_{17}$ and $R_{18}$, which may be the same or different, each represent a hydrogen atom, an alkyl group, an aryl group, a cyano group, a halogen atom, an alkoxycarbonyl group, a carboxyl group, an aminocarbonyl group, a formyl group, an alkylcarbonyl group, an arylcarbonyl group, or an aryloxycarbonyl group; $X_{11}$ and $X_{12}$ each represent an acid anion; G represents an oxygen atom, a sulfur atom, a selenium atom, or a tellurium atom; $K^{+n}$ represents an n-valent cation selected from the group consisting of an onium ion, ions of elements of group IA or group IIA, and ions of metals of group IIB, group VIIB, group IVA, or group VA; r represents 1 or 2, and when the compound forms an inner salt, r is 1; q represents 1 or 2; and $M^{+2/q}$ represents a 2/q-valent cation.

7. The silver halide color photographic material as claimed in claim 6, wherein the compound represented by formula (Ia) , (Ib) , (Ic) , or (Id) is incorporated in any one of said three photosensitive layers.

8. The silver halide color photographic material as claimed in claim 7, wherein the compound represented by formula (Ia), (Ib), (Ic), or (Id) is incorporated in the layer having a spectral sensitivity maximum at the longest wavelength out of said three photosensitive layers.

9. The silver halide color photographic material as claimed in claim 7, wherein a compound represented by formula (Ia) is incorporated in the layer having a spectral sensitivity maximum at the longest wavelength out of said three photosensitive layers.

* * * * *

UNITED STATES PATENT AND TRADEMARK OFFICE
CERTIFICATE OF CORRECTION

PATENT NO. : 5,443,946

DATED: : August 22, 1995

INVENTOR(S) : Asami

It is certified that error appears in the above-identified patent and that said Letters Patent is hereby corrected as shown below:

IN THE CLAIMS:

In claim 1, column 48, line 5, amend "tool" to --mol--.

In claim 6, column 49, line 21, amend "en" to --an--.

Signed and Sealed this

Sixth Day of August, 1996

*Attest:*

*Attesting Officer*

BRUCE LEHMAN

*Commissioner of Patents and Trademarks*